US010758007B2

(12) United States Patent
Luedecke et al.

(10) Patent No.: US 10,758,007 B2
(45) Date of Patent: Sep. 1, 2020

(54) ARTICLE WITH THERMALLY BONDED RIBBON STRUCTURE AND METHOD OF MAKING

(71) Applicant: Under Armour, Inc., Baltimore, MD (US)

(72) Inventors: Tom Luedecke, Portland, OR (US); Carmen Zhu, Dong Won (CN)

(73) Assignee: Under Armour, Inc., Baltimore, MD (US)

( * ) Notice: Subject to any disclaimer, the term of this patent is extended or adjusted under 35 U.S.C. 154(b) by 77 days.

(21) Appl. No.: 16/026,683

(22) Filed: Jul. 3, 2018

(65) Prior Publication Data

US 2020/0008530 A1 Jan. 9, 2020

(51) Int. Cl.

| | |
|---|---|
| ***A43B 23/02*** | (2006.01) |
| ***A43D 25/20*** | (2006.01) |
| ***D04D 9/06*** | (2006.01) |

(52) U.S. Cl.

CPC ..... *A43B 23/0255* (2013.01); *A43B 23/025* (2013.01); *A43B 23/0215* (2013.01); *A43B 23/0235* (2013.01); *A43D 25/20* (2013.01); *D04D 9/06* (2013.01); *D10B 2401/041* (2013.01)

(58) Field of Classification Search

CPC ..... A43B 23/0255; A43B 23/0215; A43B 23/0235; A43B 23/025; A43D 25/20

See application file for complete search history.

(56) References Cited

U.S. PATENT DOCUMENTS

| | | | | |
|---|---|---|---|---|
| 313,301 | A | 3/1885 | Cross | |
| 586,137 | A | 7/1897 | Medger | |
| 621,922 | A | 3/1899 | Kelsall | |
| 888,476 | A | 5/1908 | Davis | |
| 1,124,184 | A | 1/1915 | Straub | |
| 1,217,463 | A | 2/1917 | Krieger | |
| 1,314,239 | A | 8/1919 | Bancroft | |
| 1,469,222 | A | 10/1923 | La Chapelle | |
| 1,773,681 | A | 8/1930 | Johnson | |
| 1,879,144 | A | 9/1932 | Emery | |
| 1,968,012 | A | 7/1934 | Boghos | |
| 2,240,626 | A | 5/1941 | Ochs | |
| 2,312,089 | A | 2/1943 | Gobeille | |
| 2,413,824 | A | 1/1947 | Glassman | |
| 3,193,948 | A * | 7/1965 | Roberts | A43B 23/0295 36/84 |

(Continued)

FOREIGN PATENT DOCUMENTS

| | | |
|---|---|---|
| CN | 2712122 | 7/2005 |
| CN | 201431021 | 3/2010 |

(Continued)

OTHER PUBLICATIONS

International Search Report and Written Opinion dated Sep. 20, 2018 in PCT/US2018/039904.

(Continued)

*Primary Examiner* — Ted Kavanaugh

(74) *Attorney, Agent, or Firm* — Plumsea Law Group, LLC

(57) ABSTRACT

A method of manufacturing an upper for an article of footwear includes dispensing ribbon in an overlapping pattern of ribbon sections to form a ribbon structure; and fixedly attaching a first ribbon section to an underlying material with thermal joining.

20 Claims, 16 Drawing Sheets

(56) References Cited

U.S. PATENT DOCUMENTS

| | | | | |
|---|---|---|---|---|
| 3,497,971 | A | 3/1970 | Hayashi | |
| 3,570,151 | A | 3/1971 | Eaton | |
| 3,704,474 | A | 12/1972 | Winkler | |
| 4,027,406 | A | 6/1977 | Salvatore | |
| 4,197,345 | A | 4/1980 | Worrall | |
| 4,254,563 | A | 3/1981 | Bruno | |
| 4,393,605 | A | 7/1983 | Spreng | |
| 5,673,639 | A | 10/1997 | Miyachi et al. | |
| 6,060,145 | A | 5/2000 | Smith et al. | |
| 6,267,068 | B1 | 7/2001 | Fickers et al. | |
| 7,032,328 | B2 | 4/2006 | Wilson et al. | |
| 7,089,691 | B1 | 8/2006 | Silvera | |
| 7,115,315 | B2 | 10/2006 | Fowler | |
| 7,293,371 | B2 | 11/2007 | Aveni | |
| 7,818,898 | B1 | 10/2010 | Orengo | |
| 8,122,616 | B2 | 2/2012 | Meschter et al. | |
| 8,595,878 | B2 | 12/2013 | Huffa et al. | |
| 8,656,606 | B2 | 2/2014 | Hooper | |
| 9,179,739 | B2 | 11/2015 | Bell et al. | |
| 9,420,844 | B2 | 8/2016 | Meir et al. | |
| 9,622,542 | B2 | 4/2017 | Greene | |
| 9,655,407 | B2 | 5/2017 | Reinhardt et al. | |
| 2002/0178610 | A1 | 12/2002 | Cheng | |
| 2003/0089000 | A1 | 5/2003 | Tseng | |
| 2003/0126762 | A1 | 7/2003 | Tseng | |
| 2003/0148076 | A1 | 8/2003 | Huang | |
| 2004/0098784 | A1 | 5/2004 | Desai | |
| 2004/0118018 | A1 | 6/2004 | Dua | |
| 2005/0153614 | A1 | 7/2005 | Dohler | |
| 2005/0241181 | A1 | 11/2005 | Cheng | |
| 2005/0262734 | A1 | 12/2005 | Cheng | |
| 2005/0262735 | A1 | 12/2005 | Cheng | |
| 2006/0048413 | A1 | 3/2006 | Sokolowski et al. | |
| 2006/0112594 | A1* | 6/2006 | Kilgore | A43B 23/0235 36/45 |
| 2007/0271822 | A1 | 11/2007 | Mescnter | |
| 2008/0163952 | A1 | 7/2008 | Huang | |
| 2009/0071041 | A1 | 3/2009 | Hooper | |
| 2009/0133287 | A1 | 5/2009 | Meschter | |
| 2010/0107442 | A1 | 5/2010 | Hope et al. | |
| 2011/0041359 | A1 | 2/2011 | Dojan et al. | |
| 2011/0237995 | A1 | 9/2011 | Ota et al. | |
| 2011/0287212 | A1 | 11/2011 | Miloslavsky | |
| 2011/0309774 | A1 | 12/2011 | Peng et al. | |
| 2012/0023778 | A1 | 2/2012 | Dojan et al. | |
| 2012/0198727 | A1 | 8/2012 | Long | |
| 2012/0270455 | A1 | 10/2012 | Morishita | |
| 2012/0297642 | A1 | 11/2012 | Schaefer et al. | |
| 2012/0324658 | A1 | 12/2012 | Dojan et al. | |
| 2013/0081307 | A1 | 4/2013 | del Biondi et al. | |
| 2013/0139329 | A1 | 6/2013 | Ferniani et al. | |
| 2013/0247417 | A1 | 9/2013 | Nurse et al. | |
| 2013/0255103 | A1 | 10/2013 | Dua et al. | |
| 2013/0312284 | A1* | 11/2013 | Berend | A43B 1/0027 36/84 |
| 2014/0020193 | A1 | 1/2014 | Dojan et al. | |
| 2014/0059883 | A1 | 3/2014 | Adeagbo et al. | |
| 2014/0130270 | A1 | 5/2014 | Baudouin et al. | |
| 2014/0157623 | A1 | 6/2014 | Dekovic | |
| 2014/0165422 | A1 | 6/2014 | Pfister et al. | |
| 2014/0173934 | A1 | 6/2014 | Bell | |
| 2014/0223768 | A1 | 8/2014 | Berend et al. | |
| 2014/0237858 | A1 | 8/2014 | Adami et al. | |
| 2014/0238082 | A1 | 8/2014 | Meir | |
| 2014/0283411 | A1 | 9/2014 | Nabernik et al. | |
| 2014/0310986 | A1 | 10/2014 | Tamm et al. | |
| 2014/0338222 | A1 | 11/2014 | Song | |
| 2014/0373389 | A1 | 12/2014 | Bruce | |
| 2015/0210034 | A1 | 7/2015 | Tarrier et al. | |
| 2015/0233028 | A1 | 8/2015 | Tomiyori et al. | |
| 2015/0272272 | A1 | 10/2015 | Scofield | |
| 2015/0272274 | A1 | 10/2015 | Berns et al. | |
| 2016/0213095 | A1 | 7/2016 | Kohatsu et al. | |
| 2016/0286898 | A1 | 10/2016 | Manz et al. | |
| 2016/0305051 | A1 | 10/2016 | Oberste et al. | |
| 2016/0316855 | A1 | 11/2016 | Berns et al. | |
| 2016/0316856 | A1 | 11/2016 | Berns et al. | |
| 2016/0345674 | A1 | 12/2016 | Bruce et al. | |
| 2016/0345675 | A1 | 12/2016 | Bruce et al. | |
| 2016/0345677 | A1 | 12/2016 | Bruce et al. | |
| 2016/0345678 | A1 | 12/2016 | Mokos | |
| 2016/0353828 | A1 | 12/2016 | Chen | |
| 2017/0143076 | A1 | 5/2017 | Farris | |
| 2017/0156434 | A1 | 6/2017 | Tamm et al. | |
| 2017/0156439 | A1 | 6/2017 | Yoshida et al. | |
| 2017/0156445 | A1 | 6/2017 | Guest et al. | |
| 2017/0157846 | A1 | 6/2017 | Miller et al. | |
| 2017/0188664 | A1* | 7/2017 | Manz | A43D 25/07 |
| 2017/0332722 | A1 | 11/2017 | Dealey et al. | |
| 2017/0340064 | A1 | 11/2017 | Salomon | |
| 2018/0116317 | A1 | 5/2018 | Inoue et al. | |
| 2018/0343959 | A1 | 12/2018 | Bruce et al. | |
| 2019/0166950 | A1 | 6/2019 | Sinclair | |

FOREIGN PATENT DOCUMENTS

| | | | |
|---|---|---|---|
| CN | 103989290 | | 8/2014 |
| FR | 2626201 | A1 | 7/1989 |
| GB | 1079731 | A | 8/1967 |
| JP | 06057613 | A | 3/1994 |
| JP | 08246323 | A | 9/1996 |
| JP | 2016195676 | A | 11/2016 |
| TW | 340310 | | 9/1998 |
| TW | 351073 | | 1/1999 |
| TW | 351670 | | 2/1999 |
| TW | 353601 | | 3/1999 |
| TW | M433121 | | 3/1999 |
| TW | 412939 | | 11/2000 |
| TW | 503275 | | 9/2002 |
| TW | 521584 | | 2/2003 |
| TW | M257116 | | 2/2005 |
| TW | M357218 | | 5/2009 |
| TW | M378896 | | 4/2010 |
| TW | M420202 | | 1/2012 |
| TW | M433118 | | 7/2012 |
| TW | M437635 | | 9/2012 |
| TW | M451012 | | 4/2013 |
| TW | M456105 | | 7/2013 |
| TW | M476494 | | 4/2014 |
| TW | M476496 | | 4/2014 |
| TW | M527445 | | 8/2016 |
| WO | 90/03744 | A1 | 4/1990 |
| WO | 2015038243 | A1 | 3/2015 |
| WO | 2020/009813 | | 1/2020 |
| WO | 2020/009814 | | 1/2020 |

OTHER PUBLICATIONS

Paiho Sparta III Website, available at: http://www.paiho.com/index.php/en/menu-en-left-np-sparta (Nov. 3, 2015).

International Search Report and Written Opinion dated May 1, 2019 for Application No. PCT/US2019019481.

International Search Report and Written Opinion dated May 1, 2019 for Application No. PCT/US2019/019490.

International Search Report and Written Opinion dated May 7, 2019 for Application No. PCT/US2019/019492.

International Search Report and Written Opinion dated May 13, 2019 for Application No. PCT/US2019/019486.

Wikipedia, "Stich (textile arts)" May 6, 2016 (May 6, 2016), retrieved on Apr. 24, 2019 from https://en.wikipedia.org/w/index.php?title=Stitch_(textile_arts)&oldid=718918887.

International Search Report and Written Opinion dated Sep. 11, 2019 for Application No. PCT/US2019/038388.

International Search Report and Written Opinion dated Sep. 17, 2019 for Application No. PCT/US2019/038392.

* cited by examiner

ARTICLE WITH THERMALLY BONDED RIBBON STRUCTURE AND METHOD OF MAKING

BACKGROUND

Embroidery is a traditional method of decorating, tailoring, mending, patching, or reinforcing textile materials by sewing with a needle and stitching material. Hand-embroidered goods date back as late as the Warring States period in China. During the industrial revolution, the invention of the sewing machine and dedicated embroidery machines expanded the use of the technique. Modern embroidery techniques may utilize machine-readable code to autonomously create an embroidery pattern on a sheet of textile materials. Textile materials include fabrics such as cotton, wool, or silk, as well as leather, foam, polymer sheets, and synthetic equivalents. On the textile materials, a number of stitch techniques (such as the chain stitch, the buttonhole or blanket stitch, the running stitch, the satin stitch, or the cross stitch) may be used depending on the purpose of the embroidery. The stitching techniques may be used in combination to form a variety of set patterns. The stitching patterns may be decorative; for example, the pattern may form a flower or series of flowers. Alternatively, the stitching may be structural, such as stitching along the edges of a garment to reinforce the seams. In further cases, the stitching may be both decorative and functional, such as the use of a floral pattern used to reinforce a patch.

Typically, a thread or yarn is used as the stitching material and stitched into the textile. Commonly, the thread or yarn may be made of cotton or rayon, as well as traditional materials like wool, linen, or silk. However, embroidery may also sew in dissimilar materials to the textile, usually for decorative purposes. For example, thread created out of precious metals such as gold or silver may be embroidered within more traditional fabrics such as silk. Additional elements (such as beads, quills, sequins, pearls, or entire strips of metal) may be sewn in during embroidery. These elements may be sewn in along with yarn or thread using a variety of stitching techniques, depending on the desired placements of the elements.

Thermal bonding is used to join components of garments and footwear. For example, the upper of an article of footwear is often formed from a plurality of material elements, which may be joined together to define a void or cavity on the interior of the footwear for receiving a foot. In order to join two or more material elements, one or more of the material elements to be joined may be at least partially softened or melted such that the materials of the elements are secured to each other when cooled.

SUMMARY

In one aspect, the present disclosure is directed to an article of footwear having an upper including a ribbon structure formed by a plurality of ribbon sections arranged in an overlapping pattern. The plurality of ribbon sections may include a first ribbon section fixedly attached to an underlying material with a thermal joint.

In another aspect, the present disclosure is directed to an article of footwear having an upper including a ribbon structure formed by a plurality of ribbon sections arranged in an overlapping pattern. The plurality of ribbon sections including a first layer of ribbon sections and a second layer of ribbon sections. In addition, the article of footwear includes a plurality of thermal joints selectively, fixedly attaching the first layer of ribbon sections to the second layer of ribbon sections.

In another aspect, the present disclosure is directed to an article of footwear having an upper including a ribbon structure formed by a plurality of ribbon sections arranged in an overlapping pattern, such that the ribbon structure includes a plurality of overlapping regions. The plurality of ribbon sections are translucent and have a first opacity. In addition, the overlapping regions have a second opacity that is greater than the first opacity.

In another aspect, the present disclosure is directed to a method of manufacturing an upper for an article of footwear. The method includes dispensing ribbon in an overlapping pattern of ribbon sections to form a ribbon structure; and fixedly attaching a first ribbon section to an underlying material with thermal joining.

In another aspect, the present disclosure is directed to a method of manufacturing an upper for an article of footwear. The method includes forming a ribbon structure including a plurality of ribbon sections arranged in an overlapping pattern, the plurality of ribbon sections including a first set of ribbon sections and a second set of ribbon sections. The method also includes selectively, fixedly attaching the first set of ribbon sections to the second set of ribbon sections with thermal joining.

In another aspect, the present disclosure is directed to a method of manufacturing an upper for an article of footwear. The method includes forming a ribbon structure including a plurality of ribbon sections including a first set of ribbon sections and a second set of ribbon sections arranged in an overlapping pattern to form a plurality of overlapping regions. In addition, the method includes selectively, fixedly attaching the first set of ribbon sections to the second set of ribbon sections with thermal joining. Further, the plurality of ribbon sections are translucent and have a first opacity and the overlapping regions have a second opacity that is greater than the first opacity.

Other systems, methods, features, and advantages of the embodiments will be, or will become, apparent to one of ordinary skill in the art upon examination of the following figures and detailed description. It is intended that all such additional systems, methods, features, and advantages be included within this description and this summary, be within the scope of the embodiments, and be protected by the following claims.

BRIEF DESCRIPTION OF THE DRAWINGS

The embodiments can be better understood with reference to the following drawings and description. The components in the figures are not necessarily to scale, with emphasis instead being placed upon illustrating the principles of the embodiments. Moreover, in the figures, like reference numerals designate corresponding parts throughout the different views.

DETAILED DESCRIPTION

The embodiments are related to an article including one or more ribbons, or portions of ribbon (e.g., ribbon sections). As used herein, the term "article" refers broadly to articles of footwear, articles of apparel (e.g., clothing), as well as accessories and/or equipment. For the purposes of general reference, an article is any item designed to be worn by or on a user, or act as an accessory. In some embodiments, an article may be an article of footwear, such as a shoe, sandal, boot, etc. In other embodiments, an article may be an article of apparel, such as a garment, including shirts, pants, jackets, socks, undergarments, or any other conventional item. In still other embodiments, an article may be an accessory such as a hat, glove, or bag worn by the wearer.

Articles of footwear include, but are not limited to, hiking boots, soccer shoes, football shoes, sneakers, running shoes, cross-training shoes, rugby shoes, basketball shoes, baseball shoes as well as other kinds of shoes. Moreover, in some embodiments, components may be configured for various kinds of non-sports-related footwear, including, but not limited to, slippers, sandals, high-heeled footwear, loafers as well as any other kinds of footwear. Articles of apparel include, but are not limited to, socks, pants, shorts, shirts, sweaters, undergarments, hats, gloves, as well as other kinds of garments. Accessories include scarves, bags, purses, backpacks, as well as other accessories. Equipment may include various kinds of sporting equipment including, but not limited to, bats, balls, various sporting gloves (e.g., baseball mitts, football gloves, ski gloves, etc.), golf clubs, as well as other kinds of sporting equipment.

To assist and clarify the subsequent description of various embodiments, various terms are defined herein. Unless otherwise indicated, the following definitions apply throughout this specification (including the claims). For consistency and convenience, directional adjectives are employed throughout this detailed description corresponding to the illustrated embodiments.

Figure 1:
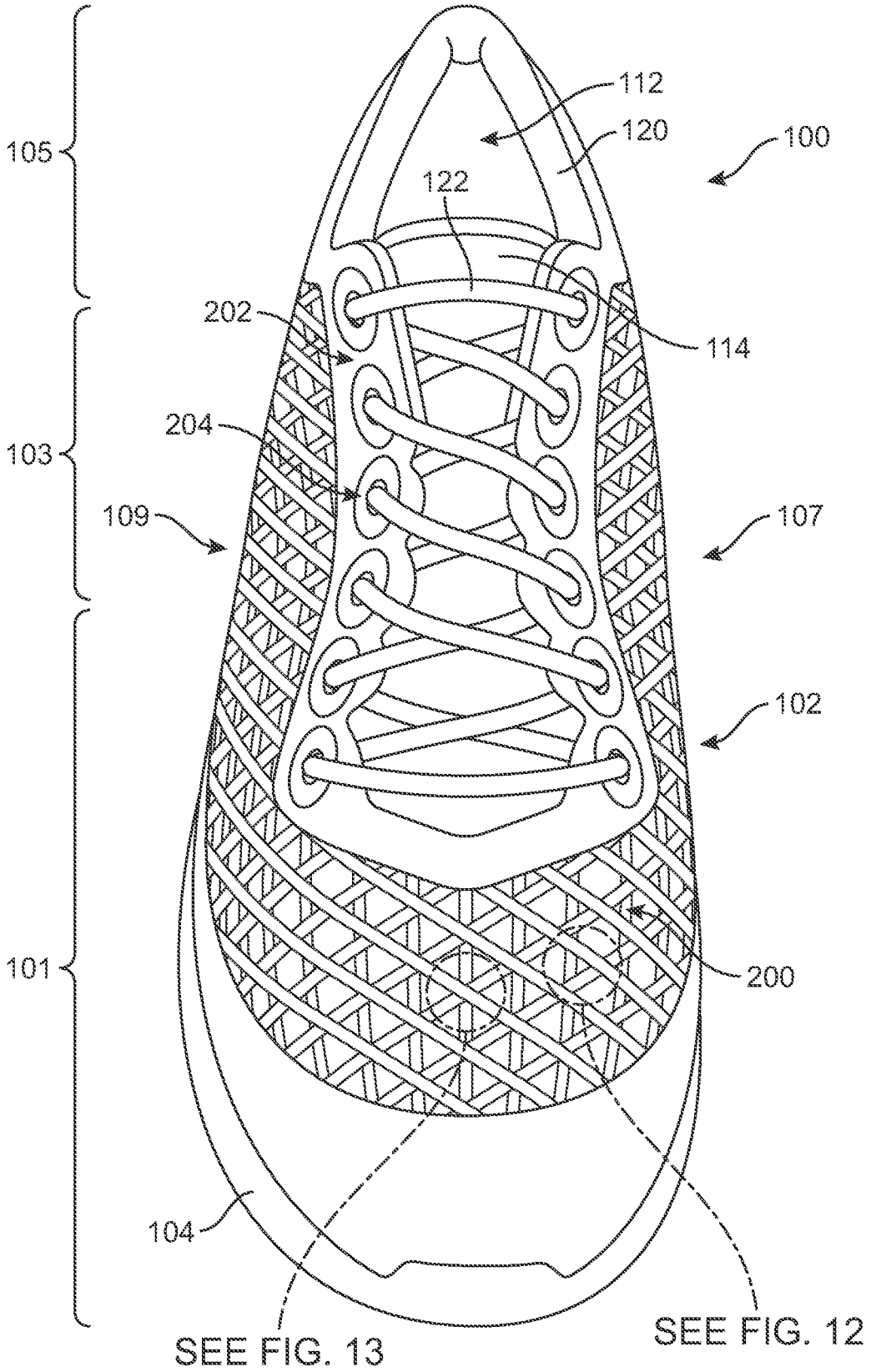
FIG. 1 is a schematic view of an embodiment of an article of footwear.

For purposes of general reference, as illustrated in FIG. 1, an article of footwear 100 may be divided into three regions: a forefoot region 101, a midfoot region 103, and a heel region 105. Forefoot region 101 may be generally associated with the toes and joints connecting the metatarsals with the phalanges. Midfoot region 103 may be generally associated with the arch of a foot, including the instep. Likewise, heel region 105 or "hindfoot" may be generally associated with the heel of a foot, including the calcaneus bone. For purposes of this disclosure, the following directional terms, when used in reference to an article of footwear, shall refer to the article of footwear when sitting in an upright position, with the sole facing the ground, that is, as it would be positioned when worn by a wearer standing on a substantially level surface.

The term "longitudinal," as used throughout this detailed description and in the claims, refers to a direction extending along the length of a component. For example, a longitudinal direction of an article of footwear extends from forefoot region 101 to heel region 105 of article of footwear 100. The term "forward" or "front" is used to refer to the general direction in which the toes of a foot point, and the term "rearward" or "back" is used to refer to the opposite direction, i.e., the direction in which the heel of the foot is facing.

The term "lateral direction," as used throughout this detailed description and in the claims, refers to a side-to-side direction extending along the width of a component. In other words, the lateral direction may extend between a medial side 107 and a lateral side 109 of article of footwear 100, with lateral side 109 of article of footwear 100 being the surface that faces away from the other foot, and medial side 107 being the surface that faces toward the other foot.

The term "vertical," as used throughout this detailed description and in the claims, refers to a direction generally perpendicular to both the lateral and longitudinal directions. For example, in cases where an article of footwear is planted flat on a ground surface, the vertical direction may extend from the ground surface upward. It will be understood that each of these directional adjectives may be applied to individual components of an article of footwear. The term "upward" refers to the vertical direction heading away from a ground surface, while the term "downward" refers to the vertical direction heading toward the ground surface. Similarly, the terms "top," "upper," and other similar terms refer to the portion of an object substantially furthest from the ground in a vertical direction, and the terms "bottom," "lower," and other similar terms refer to the portion of an object substantially closest to the ground in a vertical direction.

It will be understood that the forefoot region, the midfoot region, and the heel region are only intended for purposes of description and are not intended to demarcate precise regions of an article of footwear. For example, in some cases, one or more of the regions may overlap. Likewise, the medial side and the lateral side are intended to represent generally two sides, rather than precisely demarcating an article of footwear into two halves. In addition, the forefoot region, the midfoot region, and the heel region, as well as the medial side and the lateral side, may also be applied to individual components of an article of footwear, including a sole structure, an upper, a lacing system, and/or any other component associated with the article.

Article of footwear 100 may include an upper 102 and a sole or "sole structure" 104 (see also FIG. 2), which define an internal cavity between the upper and sole. The "interior" of an article of footwear refers to space in this internal cavity that is occupied by a wearer's foot when the article of footwear is worn. The "inner side" or "inside" of an element refers to the face of that element that is (or will be) oriented toward the internal cavity in a completed article of footwear. The "outer side," "outside," or "exterior" of an element refers to the face of that element that is (or will be) oriented away from the internal cavity in the completed article of footwear 100. In some cases, the inner side of an element may have other elements between that inner side and the interior in the completed article of footwear 100. Similarly, an outer side of an element may have other elements between that outer side and the space external to the completed article of footwear 100. Further, the terms "inward" and "inwardly" shall refer to the direction toward the interior of the article of footwear, and the terms "outward" and "outwardly" shall refer to the direction toward the exterior of article of footwear 100.

Upper 102 provides a covering for the wearer's foot that comfortably receives and securely positions the foot with respect to the sole structure. In general, upper 102 includes an opening 112 that provides entry for the foot into an interior cavity of upper 102 in heel region 105. Upper 102 may be of a variety of styles depending on factors such as desired use and required ankle mobility. For example, an athletic shoe with upper 102 having a "low-top" configuration extending below the ankle that is shaped to provide high mobility for an ankle. However, upper 102 could be configured as a "high-top" upper extending above the wearer's ankle for basketball or other activities, or as a "mid-top" configuration extending to about the wearer's ankle. Furthermore, upper 102 may also include non-athletic shoes, such as dress shoes, loafers, sandals, and work boots. Upper 102 may also include a tongue 114 that provides cushioning and support across the instep of the foot.

Upper 102 may also include other known features in the art including heel tabs, loops, etc. Furthermore, upper 102 may include a toe cage or box in the forefront region. Even further, upper 102 may include logos, trademarks, and instructions for care.

Upper 102 may include a fastening provision on a fastening region of the upper. For example, the fastening provision may be a lacing system 122, or "lace," applied at a fastening region of upper 102. Other embodiments of fastening provisions, include, but are not limited to, laces, cables, straps, buttons, zippers as well as any other provisions known in the art for fastening articles. For a lacing system, the fastening region may comprise one or more eyelets. In other embodiments, the fastening region may comprise one or more tabs, loops, hooks, D-rings, hollows, or any other provisions known in the art for fastening regions.

Sole structure 104 is positioned between a foot of a wearer and the ground, and may incorporate various component elements. For example, sole structure 104 may include one or more of inner sole components or "insoles," a middle sole element or "midsole," and an outer sole element or "outsole." An insole may take the form of a sockliner adjacent the wearer's foot to provide a comfortable contact surface for the wearer's foot. It will be understood that an insole may be optional. Further, a midsole may directly serve as a cushion and support for the foot. In addition, an outsole may be configured to contact the ground surface.

Upper 102 and sole structure 104 may be coupled using any conventional or suitable manner, such as adhesion or bonding, via a woven connection, via one or more types of fasteners, etc. Additionally, in some embodiments, sole structure 104 and upper 102 may be combined together in a single unitary construction.

Sole structure 104 may contact a ground surface and have various features to deal with the ground surface. Examples of ground surfaces include, but are not limited to, indoor ground surfaces such as wood and concrete floors, pavement, natural turf, synthetic turf, dirt, as well as other surfaces. In some cases, the lower portions of sole structure 104 may include provisions for traction, including, but not limited to, traction elements, studs, and/or cleats.

Sole structure 104 may be made of a variety of any suitable material or pluralities of materials for a variety of functions. For example, one or more components of sole structure 104, such as the midsole, may be formed from a polymer foam (e.g., a polyurethane or ethylvinylacetate foam) material that attenuates ground reaction forces (i.e., provides cushioning) during walking, running, and other ambulatory activities. In addition, the components of a sole may also include gels, fluid-filled chambers, plates, moderators, inserts, or other elements that further attenuate forces, enhance stability, or influence the motions of the foot. In addition, the other components may have specific surface properties, such as an outsole being made from a durable material, such as carbon or blown rubber, which is further textured to impart traction. Furthermore, the insole may be made from a waterproof material such as a synthetic such as ethylvinylacetate to prevent moisture seeping into the sole.

In addition, for purposes of this disclosure, the term "fixedly attached" shall refer to two components joined in a manner such that the components may not be readily separated (for example, without destroying one or both of the components). Exemplary modalities of fixed attachment may include joining with permanent adhesive, rivets, stitches, nails, staples, welding or other thermal joining, or other joining techniques. In addition, two components may be "fixedly attached" by virtue of being integrally formed, for example, in a molding process.

For purposes of this disclosure, the term "removably attached" shall refer to components that are joined in a manner such that the two components are secured together, but may be readily detached from one another. Examples of removable attachment mechanisms may include hook and loop fasteners, friction fit connections, interference fit connections, threaded connectors, cam-locking connectors, and other such readily detachable connectors. Similarly, "removably disposed" shall refer to the assembly of two components in a non-permanent fashion.

The term "strand" includes a single fiber, filament, or monofilament, as well as an ordered assemblage of textile fibers having a high ratio of length to diameter and normally used as a unit (e.g., slivers, roving, single yarns, plies yarns, cords, braids, ropes, etc.). The term "thread" as used herein may refer to a strand used for stitching.

Some of the disclosed embodiments involve methods of embroidering or sewing one or more elements to a substrate. Embroidering an element to a substrate comprises stitching the element in place with a thread, yarn, or other strand of material.

The present application is directed to an upper including ribbon and portions or sections of ribbon. As used herein, the term "ribbon" refers to a long, narrow strip of material. In addition to the provisions described herein and shown in the figures, the embodiments may make use of any of the structures, components, and/or methods for articles with ribbon as disclosed in Luedecke et al., U.S. Patent Application Publication Number 2019/0017205, currently application Ser. No. 15/648,638, filed Jul. 13, 2017 and titled "Article with Embroidered Ribbon sections," the entirety of which is herein incorporated by reference.

Figure 2:
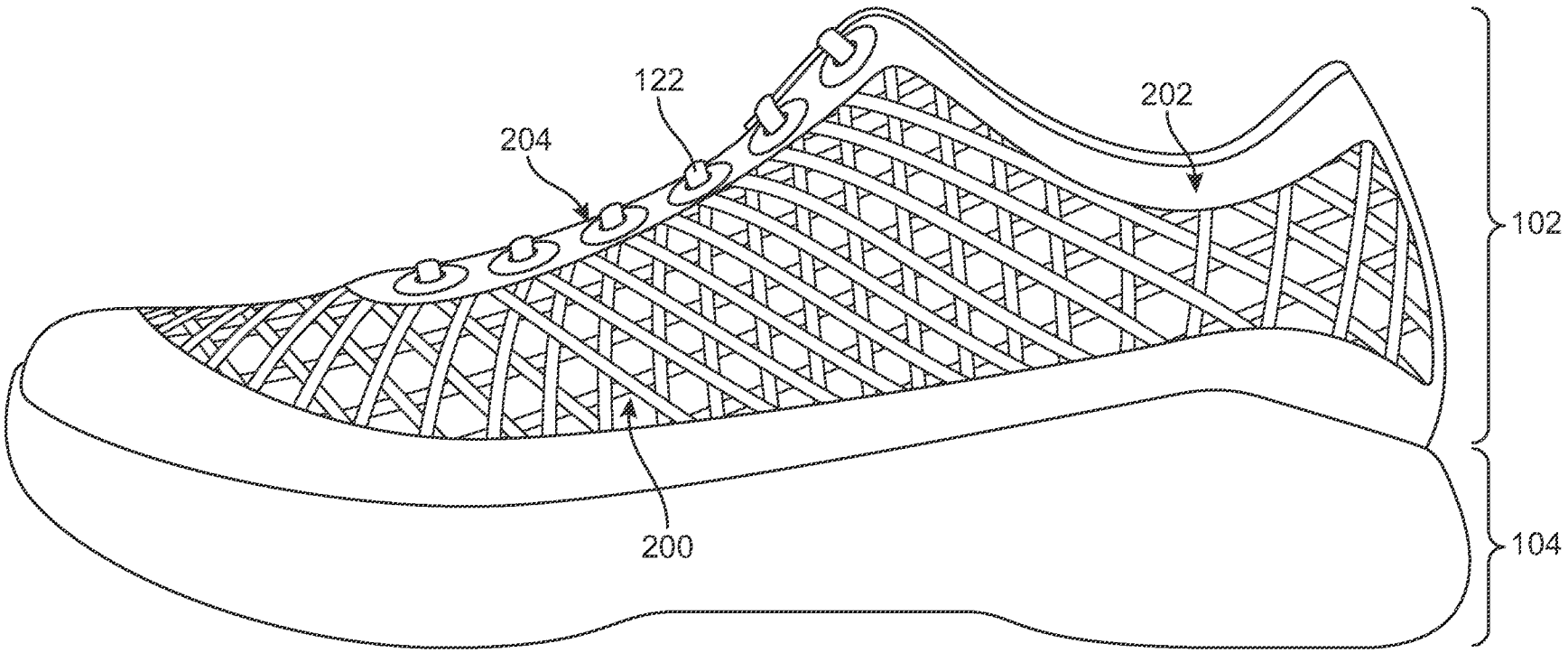
FIG. 2 is a schematic side view of an embodiment of an article of footwear.

FIG. 2 is a schematic side view of an embodiment of article of footwear 100. Referring to FIGS. 1-2, upper 102 may be comprised of a ribbon structure 200, a border element 202, and eyelet reinforcing elements 204. The term "ribbon structure," as used throughout this detailed description and in the claims, refers to any structure that is formed by attaching or otherwise arranging one or more ribbon pieces, segments, sections, or portions into a structure on an upper. In some embodiments, ribbon structure 200 may extend through the entirety of upper 102. In some cases, ribbon structure 200 extends through forefoot region 101, midfoot region 103, and heel region 105 as well as through both medial side 107 and lateral side 109. In contrast, in some embodiments, border element 202 may extend only on various edges or boundaries of upper 102. In the embodiment of FIG. 2, border element 202 extends along edges of upper 102 that are attached to sole structure 104 as well as along the periphery of opening 112.

While the exemplary embodiment includes eyelet reinforcing elements 204, other embodiments may not include reinforcing elements. In such embodiments, eyelets may be formed from openings in border element 202.

In some embodiments, upper 102 may further include an inner lining 120. Inner lining 120 could be any kind of lining known in the art for use in footwear. In some cases, inner lining 120 could be a knit or mesh lining. In still other embodiments, upper 102 may not include an inner lining and instead ribbon structure 200 could be a freestanding structure.

In some cases, ribbon sections could be separate segments or pieces (i.e., detached at their ends from one another). In other cases, ribbon sections could be part of a continuous ribbon element with no natural boundary between adjacent sections.

Ribbon sections may generally have a width that is greater than their thickness, giving them a two-dimensional appearance in contrast to threads or other strands that have a one-dimensional appearance. Further in contrast to strands or other substantially one-dimensional materials that may be used, for example, in meshes, ribbon or substantially two-dimensional pieces of material (e.g., strips) may better resist stretching under tension, especially in a longitudinal direction. In some cases, using ribbons may also help increase comfort due to the increased surface contact area between the ribbons and a foot (or overlying layer of the foot, such as a sock, or other liner in the footwear).

Figure 16:
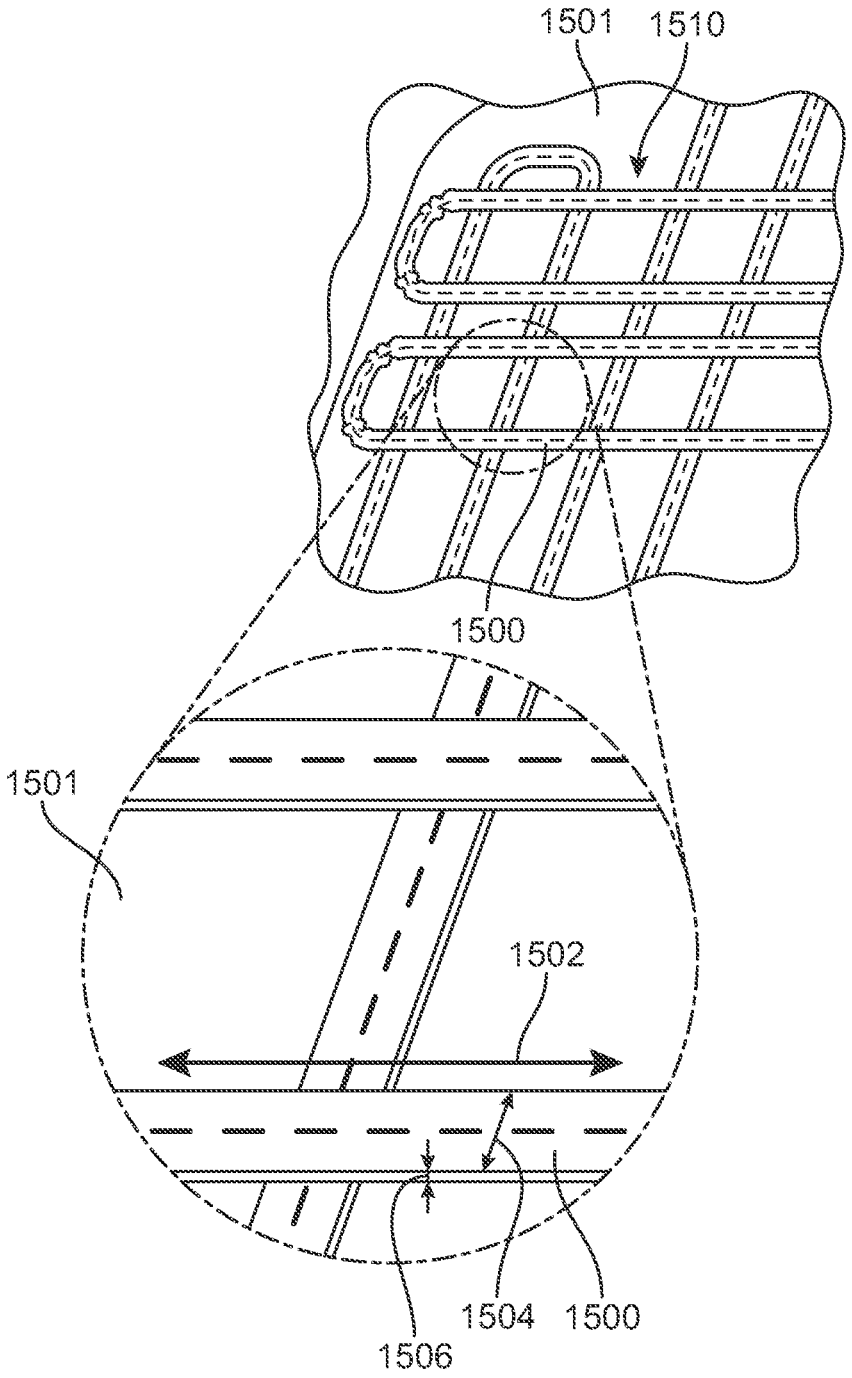
FIG. 16 is a schematic view of an embodiment of an article with an enlarged view of a region of a ribbon structure.

In different embodiments, the dimensions of one or more ribbons could vary. For example, the thickness of a ribbon could vary in a range between approximately 0.2 millimeters and 1 millimeter. As another example, the width of a ribbon could vary in a range between approximately 2 millimeters and 6 millimeters. If the width is substantially less than 2 millimeters the ribbon may be more difficult to stitch, weld, or otherwise attach to a backing layer or other element (e.g., another ribbon section). If the width is substantially greater than 6 millimeters, the ribbon may tend to bend or fold with respect to a lengthwise direction, which may make attachment more difficult. In one embodiment, the width may be approximately 3 millimeters. The length of the section or segment of ribbon may generally vary according to the particular pattern or design for an article and may generally be substantially greater than 10 millimeters. For purposes of clarity, FIG. 16 illustrates an exemplary embodiment of a ribbon section 1500 with various dimensions. Ribbon section 1500 has been stitched down to a backing layer 1501 as part of a ribbon structure 1510. Ribbon section 1500 may have a lengthwise direction 1502. Ribbon section 1500 may intersect one or more ribbon sections as it extends along lengthwise direction 1502. Ribbon section 1500 also includes a width 1504 and a thickness 1506.

The material of one or more ribbons may vary. In some embodiments, the material may be of a polymer material including a thermoplastic. Examples of thermoplastics include, but are not limited to: thermoplastic polyurethane (TPU), polyethylene, or ethylene vinyl acetate (EVA). In some embodiments, ribbons could comprise a fabric material. In various embodiments, the ribbons may be made from a foam. In still other embodiments, the ribbons could be comprised of a film. In still other embodiments, ribbons could be composite with multiple layers—including polymer layers and fabric layers, for example.

In some embodiments, a ribbon may be made of a material that undergoes little to no stretch under tension. This may help ensure the ribbon provides strength and support to parts of a foot along a tensioned direction. In one embodiment, ribbons could be made of a woven material that resists stretching. Moreover, the woven material may comprise a 0 and 90 degree weave arranged as a single layer.

In some embodiments, ribbons could be made of materials that expand under heat and/or pressure. Exemplary expanding materials include foam materials, expanding polymers, expanding films, and/or other expandable materials.

In some embodiments, tapes could be formed of a hot melt material that melts under heat and/or pressure. Exemplary materials that may be used as part of a hot melt material include, but are not limited to, ethylene-vinyl acetates, polyolefins, polyamides and polyesters, polyurethanes, styrene block copolymers, polycarbonates, fluoropolymers, silicone rubbers, etc. In some embodiments, a hot melt material could include, or consist of, thermoplastic polyurethane (TPU). Moreover, it may be appreciated that a hot melt material could comprise various combinations of the materials listed here, as well as combinations with still other materials. The specific materials used may be selected to achieve desired properties, such as a desired glass transition temperature, degree of crystallization, melt viscosity, crystallization rate, desired level of tackiness, color, resistance to water or other solvents, as well as possibly other factors.

It may be appreciated that a hot melt material can be used as an adhesive in some cases, or as a compound that can be molded with heat in other cases. For example, in some embodiments, a hot melt can be used to form various structural elements by melting ribbon sections into a desired geometry and cooling the hot melt.

In some embodiments, the ribbon may be a type of tape, for example having a layer of adhesive on one or both sides. For example, in some embodiments, the ribbon may include a layer of hot melt on one or both sides that may be activated by heating the ribbon. In embodiments in which the ribbon includes TPU, whether the entire ribbon thickness is TPU or a surface layer of hot melt is disposed on one or both sides of the ribbon, a release paper may be utilized. This release paper may prevent layers of the ribbon from sticking to one another when the ribbon is on a reel prior to dispensing.

As utilized herein, the term "thermal joining" (and variants thereof) is defined as a securing technique between two elements that involves the application of heat to abutting elements such that the materials of the elements are secured to each other when cooled. Similarly, the term "thermal joint" or variants thereof is defined as the bond, link, or structure joining two elements that is formed by the application of heat and subsequent cooling of the two elements.

Thermal joining involves heating abutting components wherein at least one of the components is formed of a thermally responsive material. Upon the application of heat, the thermally responsive material melts, softens, becomes flowable, becomes sticky, or otherwise reacts in a manner that results in the thermally responsive material of one component becoming secured to the abutting component. In some embodiments, the material may attain a liquid phase. In other embodiments, the material may not attain a liquid phase. For example, in some cases, the material of a first component may join to an abutting component by applying an amount of energy that is less than the enthalpy of fusion (a.k.a., latent heat of fusion) of the thermally responsive material. That is, the thermally responsive material may bond to the abutting material upon heating before the amount of energy required to melt a material has been applied.

In some embodiments, thermal joining may involve the heating of two components such that the materials from each component intermingle with each other, thus forming a transition region between the two components that is formed of a mixture of the two materials. In some embodiments, thermal joining may involve the heating of a material in a first component such that the material extends into or infiltrates the structure of a second component, for example, infiltrating crevices or cavities in the second component or extending around or bonding with filaments or fibers in the second component to secure the components together when cooled. Thus, thermal joining of two components together may occur when material from one or both of the components responds to the application of thermal energy. Accordingly, a thermally responsive material, such as a polymer material, may be provided in one or both of the components.

A variety of heating techniques may be utilized to thermally join components to each other. In some embodiments, suitable heating techniques may include conduction heating, radiant heating, high frequency heating (e.g., ultrasonic welding or radiofrequency (RF) welding), laser heating, or combinations of such techniques. In some embodiments, the thermal joining method used to join portions of the upper may include a high frequency heating method, such as ultrasonic welding.

In embodiments where a high frequency welding method is used to form welds in the upper, the materials of the upper may be any materials suitable for such a method. For example, materials suitable for high frequency welding may include thermoplastic material or natural material coated with a thermoplastic material. Examples of material suitable for high frequency welding methods include an acrylic, a nylon, a polyester, a polylactic acid, a polyethylene, a polypropylene, polyvinyl chloride (PVC), a urethane, a natural fiber that is coated with one or more thermoplastic materials, and combinations of such materials. In some embodiments, a natural fiber, such as cotton or wool, may be coated with a thermoplastic material, such as an ethyl vinyl acetate or thermoplastic polyurethane.

Use of thermal joining can provide various advantages over use of adhesives or stitching. For example, use of thermal joining may produce a lighter weight shoe due to the absence of stitching and adhesives. By eliminating stitching and adhesives, the mass that would otherwise be imparted by stitching and adhesives may be utilized for other structural elements that enhance the performance properties of the article of footwear, such as cushioning, durability, stability, and aesthetic qualities. Another advantage relates to manufacturing efficiency and expense. Stitching and application of adhesives can be relatively time-consuming processes. By thermal joining components, manufacturing time may be reduced. Further, costs may be reduced by eliminating the expense of adhesives or stitching materials. In addition, since adhesives and stitching can increase the rigidity of upper materials, thermal joining (that is, joining materials without using adhesives or stitching) can preserve the flexibility of the upper of the article of footwear. Flexibility of the upper can enable the upper to conform to the foot of a wearer, thus providing improved fit. By conforming to the foot of the wearer, a flexible upper may also provide improved comfort.

Figure 3:
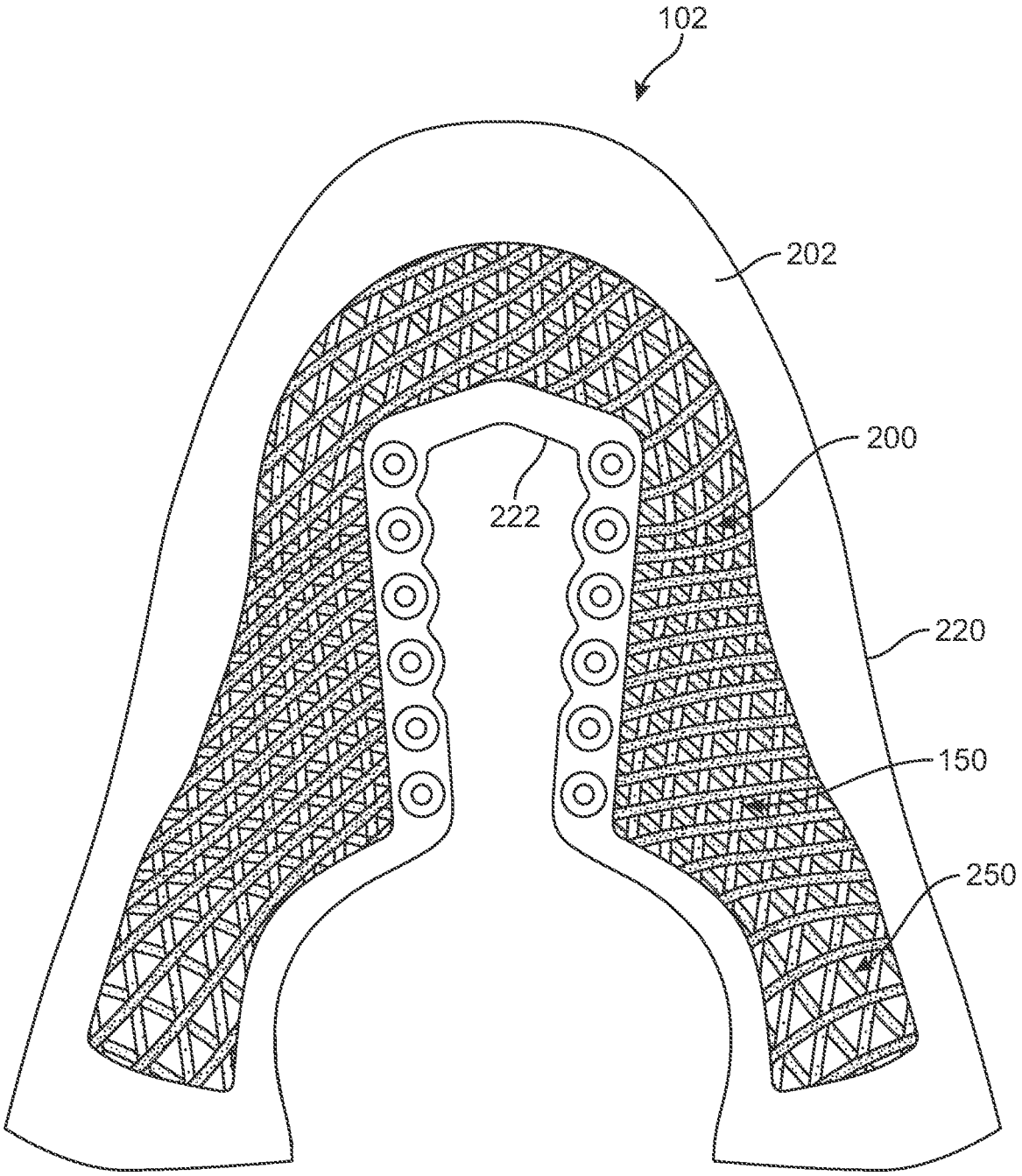
FIG. 3 is a top-down schematic view of an embodiment of an upper with a ribbon structure.

As shown in FIGS. 1-3, border element 202 extends around the edges or periphery of upper 102. In some embodiments, border element 202 is an embroidered structure comprised of thread that has been stitched through ribbon structure 200 (as well as possibly other layers including a backing layer).

In some cases, border element 202 comprises a continuous element that extends around the entire periphery of border element 202. In other cases, border element 202 may be discontinuous and may have gaps along the periphery.

In embodiments where a border element is an embroidered structure, the border element may comprise threads stitched to another layer (e.g., a ribbon layer and/or a substrate/backing layer). In some embodiments, a border element may comprise a standalone structure of threads that have been stitched together to form an interlocking matrix. The embroidered regions and/or structures of the present disclosure may utilize any of the structures, patterns, or features disclosed in Berns et al., U.S. Publication Number 2015/0272272, published on Oct. 1, 2015, filed on Mar. 25, 2015 as U.S. application Ser. No. 14/668,935, and titled "Footwear Including Textile Element," the entirety of which is herein incorporated by reference and referred to as the "Embroidered Structures Application."

As discussed in the Embroidered Structures Application, some embodiments may incorporate self-supporting embroidered structures with threads or yarns arranged in a matrix that lacks a backing or support layer. Such embroidered structures could be formed by first stitching threads to a backing layer and later removing the backing layer. The embodiments can use any of the methods for forming embroidered structures as disclosed in the Embroidered Structures Application.

Threads used for embroidery or other forms of stitching may be comprised from a variety of materials. For example, thread may be made of polymer materials including nylon, polyethylene, TPU, PVA, or EVA as well as Dyneema fiber made from Ultra-High Molecular Weight Polyethylene. Thread may also include a blend of polymer materials and may include nitrile rubber. Thread also may be made from more conventional materials including cotton, silk, or other natural fibers disclosed herein. Other materials that may be used include, but are not limited to, nylon, polyester, polyacrylic, polypropylene, polyethylene, metal, silk, cellulosic fibers, elastomers, etc. Thread also may be made from any known synthetic equivalent. In some embodiments, exposing the thread to heat or pressure may cause the thread to melt or fuse. In other embodiments, exposing the thread to heat or pressure may cause the thread to dissolve. In still other embodiments, the thread may dissolve when exposed to a solvent, such as acid or water.

In some embodiments, threads may be comprised of a material that stretches lengthwise under tension. For example, in some embodiments, a thread could be an elastic thread. As an example, an elastic thread comprised of 60-70% polyester and 30-40% polyurethane could be used.

A backing layer, or backer layer, may be used during the embroidery process. A backing layer, in general, provides a layer to which one or more elements may be stitched.

In some embodiments, a backing layer may remain after manufacturing to provide, for example, an inner lining for an article. In some embodiments, the backing layer may be melted into the article. In other embodiments, a backing layer could be separated from other elements of an article after embroidering one or more ribbon sections into place. In other embodiments, a backing layer could be dissolved. Some embodiments may include a backing layer that is distinct from an inner lining of an upper.

The materials of backing layers may vary. Backing layers or sheets may be used as an anti-abrasion layer, and may be made of a material soft to the skin, such as silk or cotton, as well as synthetic-like equivalents such as nylon, or foam materials. Backing layers may be used to prevent an article from stretching during embroidery, and may be used from a harder more rigid substance, such as a sheet made from TPU, PVA, or EVA. Backing layers also may be made from a fusible material such as EV, or a dissolvable material such as TPU, PVA, or EVA. Furthermore, backing layers may combine various materials for different purposes for different sections. For example, a rigid dissolvable backing material may be used in combination with a soft permanent backing layer. In some embodiments, the backing layer may include a mesh. In some embodiments, the mesh may be elastic.

FIG. 3 is a schematic top-down view of upper 102 in a flattened configuration, i.e., in a configuration immediately following manufacturing of the upper but before the upper has been shaped and joined with sole structure 104 (see FIG. 2).

As shown in FIG. 3, upper 102 has an outer peripheral edge 220 and an inner peripheral edge 222. Inner peripheral edge 222 may extend around a lacing region of upper 102 as well as around other parts of a throat opening of upper 102. Outer peripheral edge 220 may be disposed adjacent a sole structure (e.g., sole structure 104 in FIGS. 1-2) when upper 102 is assembled with the sole structure. Upper 102 also includes an outer side (visible in FIG. 3) and an inner side (not shown). The inner side is the side of upper 102 that faces an interior foot receiving cavity of upper 102 while the outer side faces away from the interior foot receiving cavity.

With respect to these edges and sides, ribbon structure 200 extends substantially continuously throughout an interior region 150 bounded by outer peripheral edge 220 and inner peripheral edge 222. In some cases, one or more continuous ribbon elements of ribbon structure 200 wind back and forth between inner peripheral edge 222 and outer peripheral edge 220 (see FIG. 4).

Also, in some cases, ribbon structure 200 extends along outer peripheral edge 220 and inner peripheral edge 222. In some embodiments, border element 202 extends along outer peripheral edge 220 and inner peripheral edge 222 but does not extend throughout the entirety of interior region 150.

Figure 4:
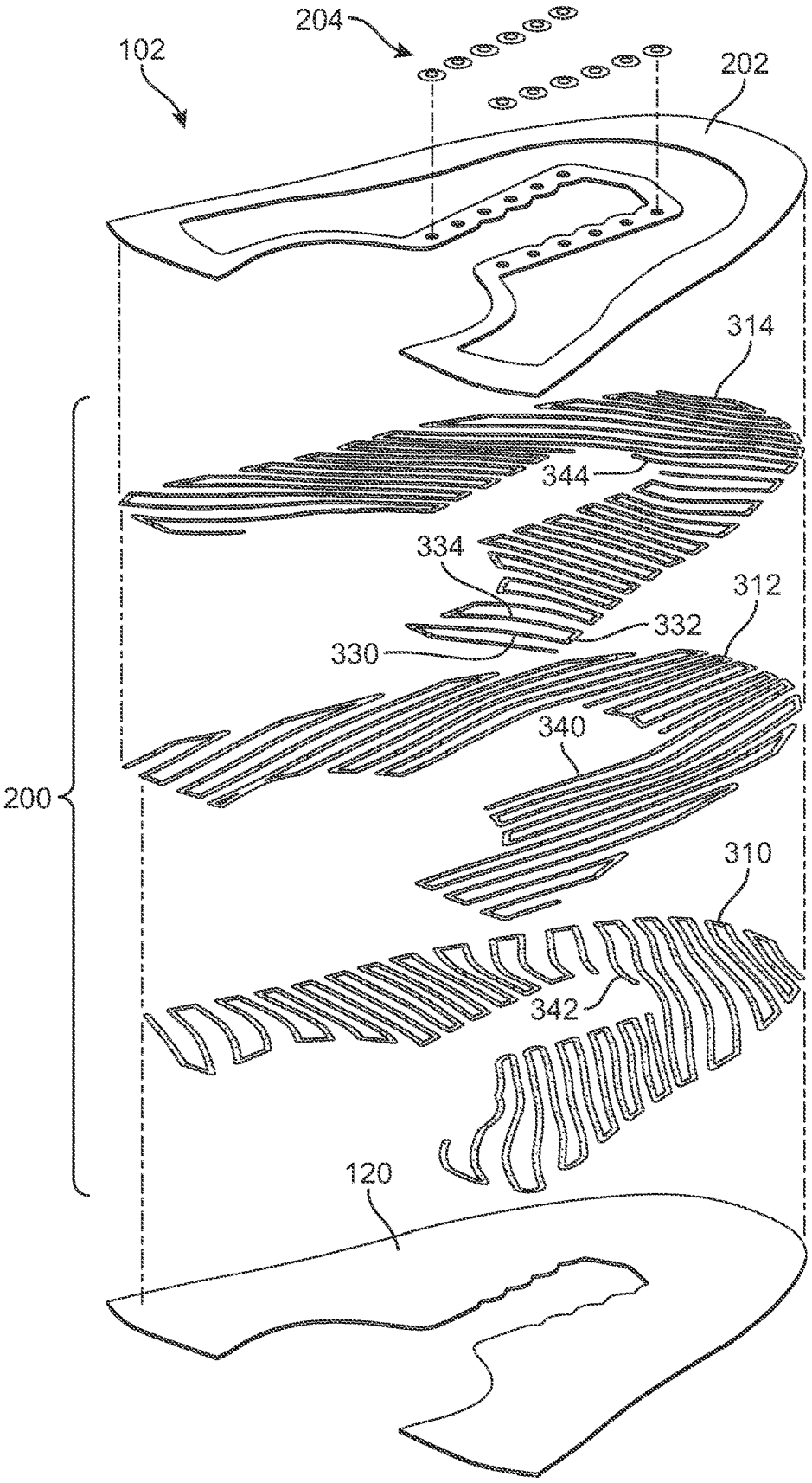
FIG. 4 is a schematic exploded view of the upper of FIG. 3.

FIG. 4 is an exploded isometric view of various layers of upper 102. Referring to FIG. 4, upper 102 includes border element 202, eyelet reinforcing elements 204, ribbon structure 200, and an inner lining 120. An optional backing or substrate layer may be disposed between ribbon structure 200 and inner lining 120 in some embodiments. In some embodiments, the backing layer and/or inner lining 120 may be omitted.

In some embodiments, a ribbon structure could be comprised of a single layer. As used herein, a layer of ribbon refers to an arrangement of one or more ribbon elements along an approximately two-dimensional surface. In some embodiments, a ribbon structure could be comprised of two or more ribbon layers. In the exemplary embodiment of FIG. 4, ribbon structure 200 is further comprised of three layers including a first ribbon layer 310, a second ribbon layer 312, and a third ribbon layer 314.

In general, ribbon elements could be arranged in a variety of different patterns including, but not limited to, lattice patterns, grid patterns, web-like patterns, various mesh patterns as well as any other kinds of patterns. The type of pattern, including characteristics such as the spacing between adjacent ribbon sections, the sizes of ribbon sections (length, width, and thicknesses), and the relative arrangements of ribbon sections (stacked, woven, etc.), can be varied to achieve particular characteristics for the resulting structure including particular strength, flexibility, durability, weight, etc.

Patterns may be formed by laying down ribbon sections in substantially straight and/or substantially curved paths within one or more layers. As used herein, a substantially straight ribbon path has a substantially higher radius of curvature than a substantially curved ribbon path.

In some embodiments, ribbon patterns within each layer may be created by laying down continuous ribbon elements in paths that have segments that are substantially straight and segments that are substantially curved. In some cases, patterns may include one or more "turns" that result in a substantial change in the ribbon element direction, thereby allowing the ribbon elements to wind (or weave) back and forth between the peripheral edges of the ribbon structure.

As an example, third ribbon layer 314 is comprised of three continuous ribbon elements that wind back and forth in a pattern bounded by the peripheral edges of upper 102. These continuous ribbon elements include both substantially straight ribbon sections (i.e., a ribbon section 330) and substantially curved ribbon sections (i.e., a ribbon section 332). Moreover, the curved ribbon sections are segments where the ribbon element "turns" back and reverses directions. So, for example, one can follow ribbon section 330 along a first approximately lateral direction toward ribbon section 332. At ribbon section 332, the ribbon element turns around and one can follow a ribbon section 334 in a second approximately lateral direction away from ribbon section 332. Likewise, both of second ribbon layer 312 and first ribbon layer 310 are comprised of one or more continuous ribbon elements arranged in winding paths including both substantially straight segments and substantially curved segments.

In some embodiments, different ribbon layers may be associated with different orientations. That is, each layer may be comprised of straight ribbon sections that extend approximately along a single direction (or axis). For example, second ribbon layer 312 is comprised of straight ribbon sections 340 that are approximately oriented along a longitudinal direction of upper 102. Also, first ribbon layer 310 is comprised of straight ribbon sections 342 that extend along various non-longitudinal directions. Likewise, third ribbon layer 314 also is comprised of straight ribbon sections 344 that extend along various non-longitudinal directions. It may be appreciated that the orientations of ribbon sections within a layer may vary. However, in some cases, the orientations of ribbon sections in different layers could vary in a predetermined manner so that the relative orientations of the different layers are preserved throughout different regions of an upper.

The orientations of the ribbon sections in each of first ribbon layer 310, second ribbon layer 312, and third ribbon layer 314 may be selected so that when these layers are assembled they form a triaxial pattern, as clearly seen in FIGS. 1-3. This triaxial pattern is created since locally the ribbon sections of each of the three ribbon layers are oriented in three approximately distinct directions. The resulting gaps or openings formed between adjacent strands have a distinct triangular geometry (e.g., a triangular gap 250 in FIG. 3).

The geometry of a ribbon structure may vary and different patterns, including variations in the number of layers, orientations of strands and relative spacing between ribbon sections may be selected according to intended uses of an article. In some embodiments, a ribbon structure comprising ribbon sections that are attached at various intersection points may provide improved flexibility, comfort, and reduce pressure points when compared to conventional upper materials. In one embodiment, a triaxial ribbon pattern may be useful for distributing stresses along three distinct directions, thereby reducing the stress in any single direction.

As seen in FIG. 4, the various turns or curved ribbon sections form open-loops or half-loops in ribbon sections along the peripheral edges of each ribbon layer and of upper 102. Moreover, when border element 202 is added to ribbon structure 200, these half-loops may be covered and hidden from view.

The exemplary disclosed embodiments provide an upper including a ribbon structure. In some embodiments, the ribbon structure may be comprised of a single continuous ribbon element that is arranged into a pattern of overlapping ribbon portions or sections. Using a single continuous ribbon element may help improve the efficiency of manufacturing by reducing the number of times a machine laying and attaching ribbon needs to stop or pause, and/or by reducing the need to include steps of cutting ribbons (either as the ribbon is laid down and/or prior to this). Moreover, by using a single continuous ribbon element for the entire ribbon structure, the tendency of separate pieces of ribbon to separate at attachment points (e.g., stitching or welding points) may be reduced, resulting in increased strength and durability for the upper.

In some embodiments, a ribbon structure may be formed by attaching one or more ribbon layers to a backing layer. In some cases, the ribbon layers may each be embroidered to the backing layer. Specifically, a first ribbon layer may be embroidered onto a backing layer. Then, a second ribbon layer may be embroidered onto the first ribbon layer and the backing layer. Then, a third ribbon layer may be embroidered onto the second ribbon layer, the first ribbon layer, and the backing layer.

Ribbons can be attached to substrate materials using any of the principles, methods, systems, and teachings disclosed in any of the following applications: Berns et al., U.S. Patent Application Publication Number 2016/0316856, published Nov. 3, 2016 and titled "Footwear Upper Including Strand Layers"; Berns et al., U.S. Patent Application Publication Number 2016/0316855, published Nov. 3, 2016 and titled "Footwear Upper Including Variable Stitch Density"; and Berns et al., U.S. Patent Application Publication Number 2015/0272274, published Oct. 1, 2015 and titled "Footwear Including Textile Element," the entirety of each application being herein incorporated by reference. Embodiments can use any known systems and methods for feeding ribbon to an embroidery or sewing machine including any of the systems and/or methods described in Miyachi et al., U.S. Pat. No. 5,673,639, issued Oct. 7, 1997, and titled "Method of feeding a piece of ribbon to a belt loop sewing machine and ribbon feeder for effecting same," the entirety of which is herein incorporated by reference.

The technique of stitching the ribbon sections to a substrate may vary. In some embodiments, the stitch technique used may include chain stitch, double chain stitch, the buttonhole or blanket stitch, the running stitch, the satin stitch, the cross stitch, or any other stitch technique known in the art. In other embodiments, a combination of known stitch techniques may be used. In further embodiments, these techniques may be used individually or in combination to stitch either individual ribbon sections or groups of ribbon sections in place.

The stitches may form a pattern. When the stitching is performed by a machine, the machine may use a computer-generated program to control the stitching, including the locations of the stitching relative to an underlying substrate, as well as how and which ribbon sections to feed, how to stitch the ribbon sections, and the technique of stitching used.

In some embodiments, only a single type of ribbon is stitched using a machine. In other embodiments, multiple types of ribbon may be stitched using the same ribbon-feeding assembly. In still other embodiments, an embroidery device may have multiple feeding assemblies to embroider multiple ribbon sections at the same time.

The method of stitching used to attach one or more ribbon sections may vary. In some embodiments, thread could be stitched around a ribbon section, thereby securing the ribbon in place on a substrate layer. In other embodiments, thread could be stitched directly through a ribbon section. In some cases, a ribbon section could have preconfigured holes for receiving stitches. In other cases, a needle may pierce a ribbon section to place a stitch through the ribbon section.

Figure 5:
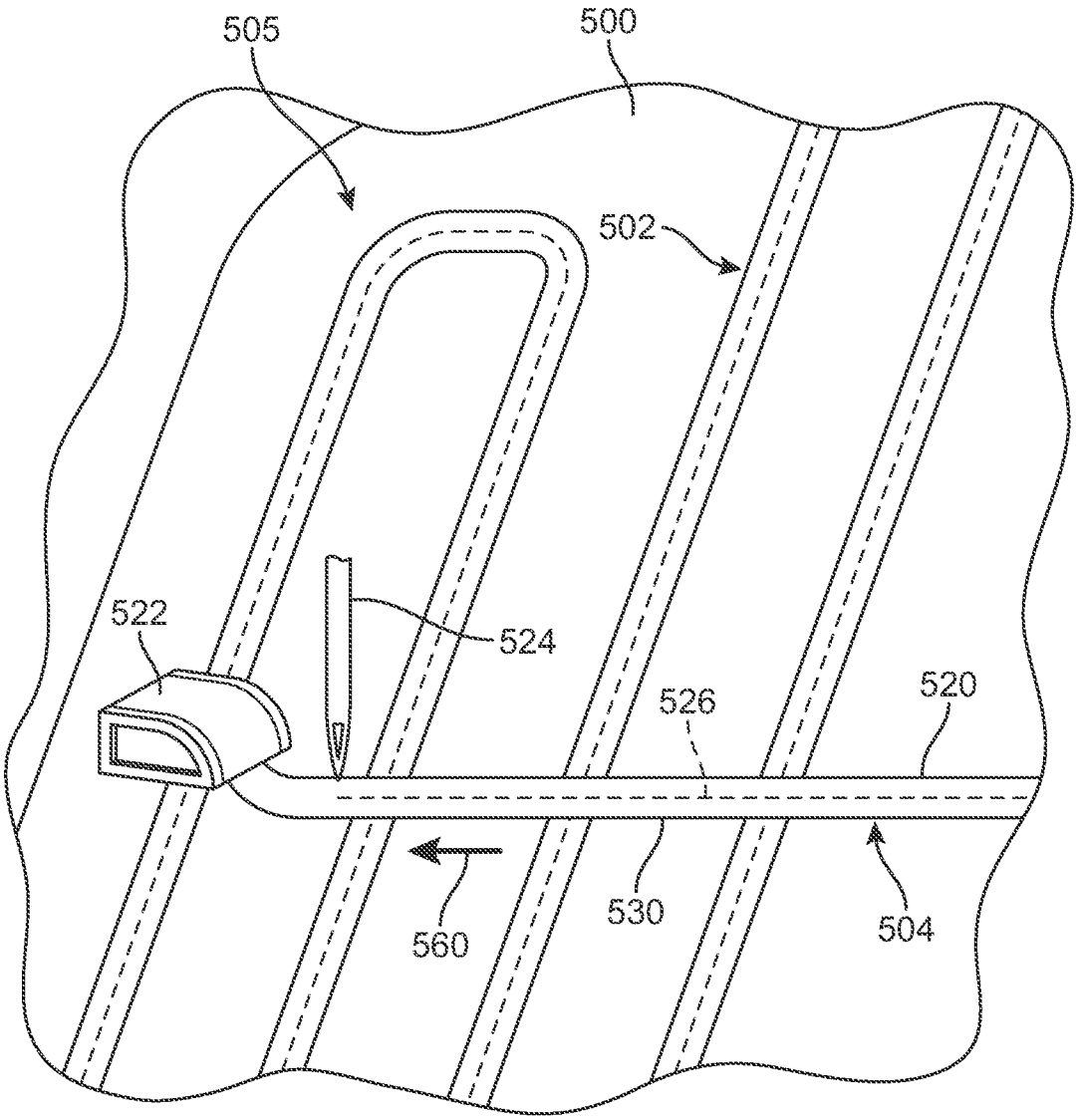
FIG. 5 is a schematic view of a process of forming a portion of an upper including multiple ribbon elements, according to an embodiment.
Figure 6:
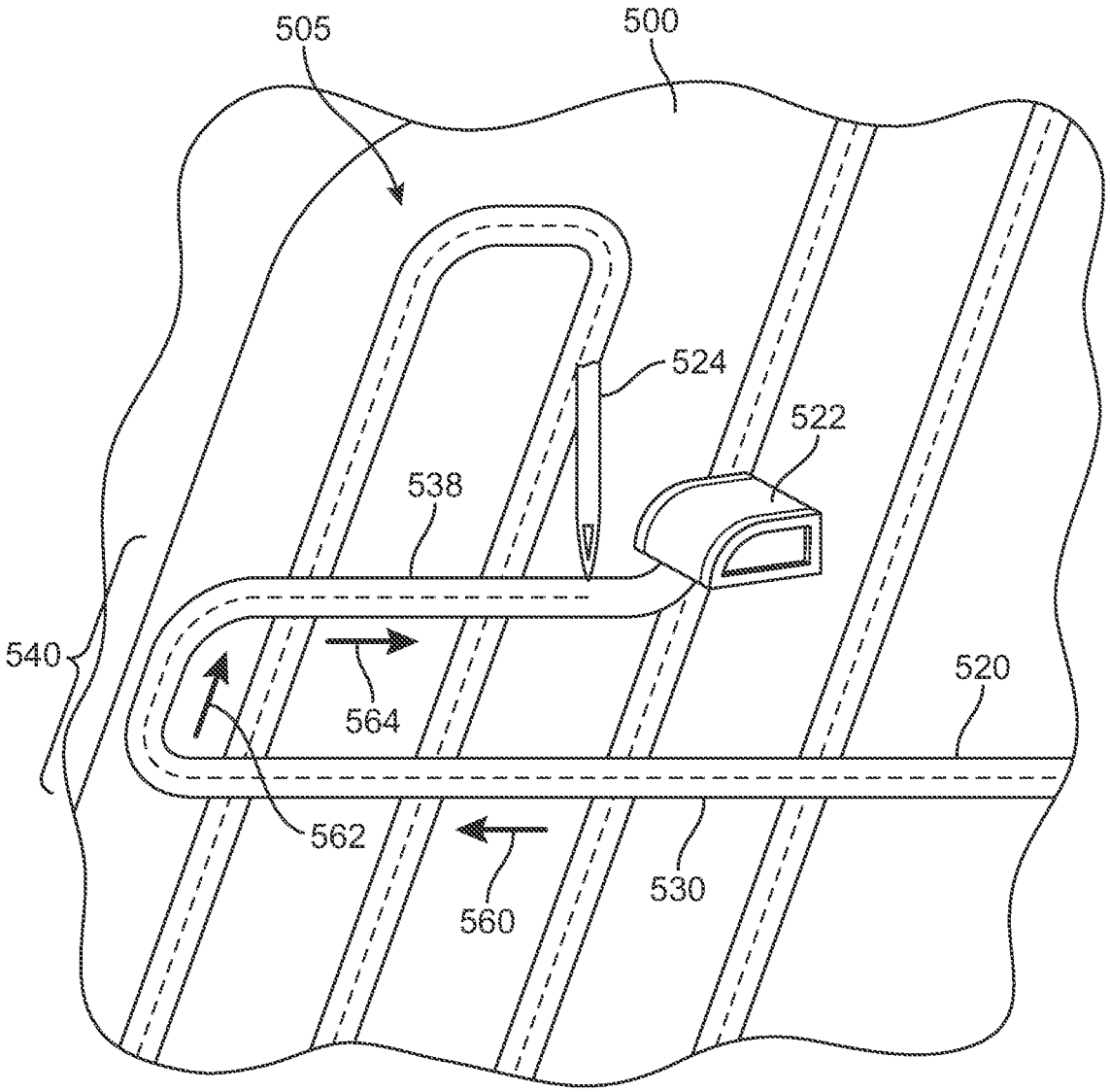
FIG. 6 is a schematic view of the process of FIG. 5 in which a ribbon feeder has turned as it lays down ribbon.

A method of manufacturing an upper for an article of footwear may include dispensing ribbon in a pattern of ribbon sections to form a ribbon structure. FIGS. 5 and 6 illustrate schematic views of a process for laying down and embroidering segments of ribbon. FIGS. 5 and 6 depict the assembly of a ribbon structure 505.

As shown in FIG. 5, ribbon structure 505 may be formed on a surface 500. In some embodiments, surface 500 may be a liner layer that remains attached to ribbon structure 505. In other embodiments, surface 500 may be a backing layer that temporarily remains attached to ribbon structure 505, as discussed above.

FIG. 5 illustrates multiple ribbon sections of a first ribbon layer 502. In addition, FIG. 5 illustrates steps in a process of laying down and embroidering ribbon sections from a second ribbon layer 504 onto surface 500 as well as over portions of first ribbon layer 502. For clarity, only two ribbon layers are shown; however, similar principles may be applied for embodiments comprising three or more layers.

As seen in FIG. 5, a ribbon element 520 may be laid down on surface 500 (and across portions of first ribbon layer 502) using ribbon feeder 522. As shown in FIG. 5, as ribbon element 520 is laid down, an embroidery needle 524 may stitch a thread 526 through ribbon element 520 to fixedly attach ribbon element 520 to surface 500 and first ribbon layer 502. For purposes of illustration, both ribbon feeder 522 and embroidery needle 524 are shown schematically. In FIG. 5, ribbon element 520 is laid down in a straight ribbon section 530 along a first direction 560 and is stitched in place.

Next, as seen in FIG. 6, ribbon feeder 522 turns to form a corner segment and continues in a second direction 562 in a turn region 540. Following this, ribbon feeder 522 turns again to form a second corner ribbon section and then continues in third direction 564 that is substantially parallel (and opposite) to first direction 560 in order to form another straight ribbon section 538. As an alternative, rather than turning ribbon feeder 522, the ribbon feeder and needle may be stationary, and the ribbon structure may be moved and turned underneath them.

This method shown in FIGS. 5 and 6 can be used to produce an upper for an article of footwear including a ribbon structure formed by a plurality of ribbon sections arranged in a pattern. The upper formed by this method further includes fixedly attaching the ribbon sections to an underlying material, such as a substrate or mesh layer, via stitching. In addition, the plurality of ribbon sections may include at least a first ribbon section fixedly attached to an underlying material with a thermal joint. In some embodiments, the underlying material is a second ribbon section of the plurality of ribbon sections. In some embodiments, the underlying material is a mesh material.

In some embodiments, the overlapping segments of the ribbon structure arranged using the method shown in FIGS. 5 and 6 may be joined to one another using thermal joining. In some cases, a heat press may be used to thermally bond overlapping segments of the ribbon structure. The heat press may also be used to thermally bond the ribbon structure to a substrate or mesh layer at the same time it thermally bonds the overlapping ribbon sections to one another. Thus, the stitching of the ribbon to the underlying material is performed after dispensing the ribbon and prior to the thermal joining of the ribbon to the underlying material.

Figure 7:
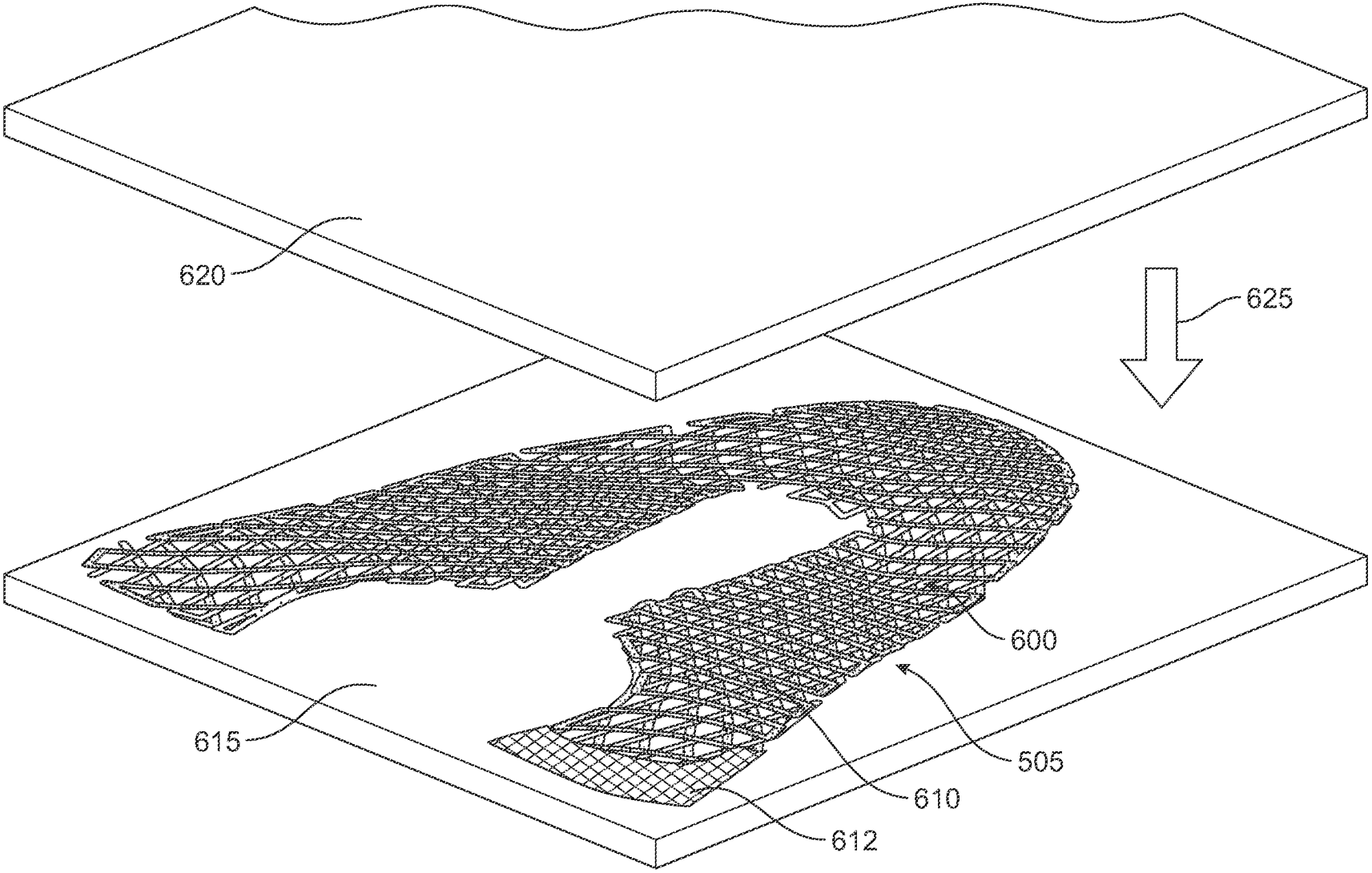
FIG. 7 is a schematic view of a process of thermally bonding elements of an upper including a ribbon structure.

FIG. 7 is a schematic view of a process of using a heat press to thermally bond elements of an upper 600 including ribbon structure 505 assembled in FIGS. 5 and 6. As shown in FIG. 7, in order to thermally bond the elements of ribbon structure 505, the layers 610 of ribbon structure 505 may be laid on a first plate 615 of a heat press. As shown in FIG. 7, a portion of a mesh 612 is shown lying under ribbon structure 505. While mesh 612 may extend under the entire surface area of ribbon structure 505, for purposes of clarity, only a portion of mesh 612 is shown.

A second plate 620 of the heat press may be pressed in a direction 625 against first plate 615, thereby compressing and heating the plurality of ribbon sections including a first layer of ribbon sections and a second layer of ribbon sections. Accordingly, the thermal joining process produces a plurality of thermal joints selectively, fixedly attaching the first layer of ribbon sections to the second layer of ribbon sections. It will be understood that the ribbon structure may include more than two layers of ribbon sections, such as the embodiment shown in FIG. 4, which includes a third layer of ribbon sections.

In some embodiments, the process of thermal joining may be performed using a high frequency heating device. For example, in some embodiments, radiofrequency (RF) welding or ultrasonic welding may be used to thermally bond the ribbon sections to one another and/or to an underlying material, such as a backing layer or mesh. That is, in some embodiments, the ribbon structure may be mounted on an underlying mesh or other substrate. In other embodiments, the ribbon structure may stand alone, for example, forming a mesh itself. In such embodiments, the segments of ribbon may be joined to one another using thermal joining in order to produce the overlapping pattern of ribbon sections. This may be performed with or without a temporary (e.g., dissolvable) backing layer to support the ribbon sections during the thermal joining process.

Ultrasonic welding may be performed using an ultrasonic horn (also referred to as a sonotrode). The ultrasonic horn is a probe that is held against a material and vibrated at high frequencies. This vibration causes friction, which creates heat at the point of contact.

As opposed to a heat press, which applies heat and pressure to a large surface area all at the same time, an ultrasonic horn enables high frequency heating in a smaller, targeted surface area. For example, the ultrasonic horn may be used to spot weld certain portions of the ribbon to the underlying material. In some cases, this may involve thermally bonding overlapping segments of ribbon to one another in the overlapping region between the two segments. In some cases, the ultrasonic horn may be used to thermally bond longer segments of ribbon. For example, even spans of ribbon that do not overlap underlying ribbon may be subjected to ultrasonic heating in order to thermally bond the non-overlapping lengths of ribbon to an underlying mesh material or other substrate. This selective, fixed attachment of ribbon to underlying material via ultrasonic welding enables the characteristics of the upper to be tuned significantly. For example, the stiffness, elasticity, weight, breathability, etc. may all be varied significantly both from shoe to shoe and at different portions of the same shoe.

Figure 8:
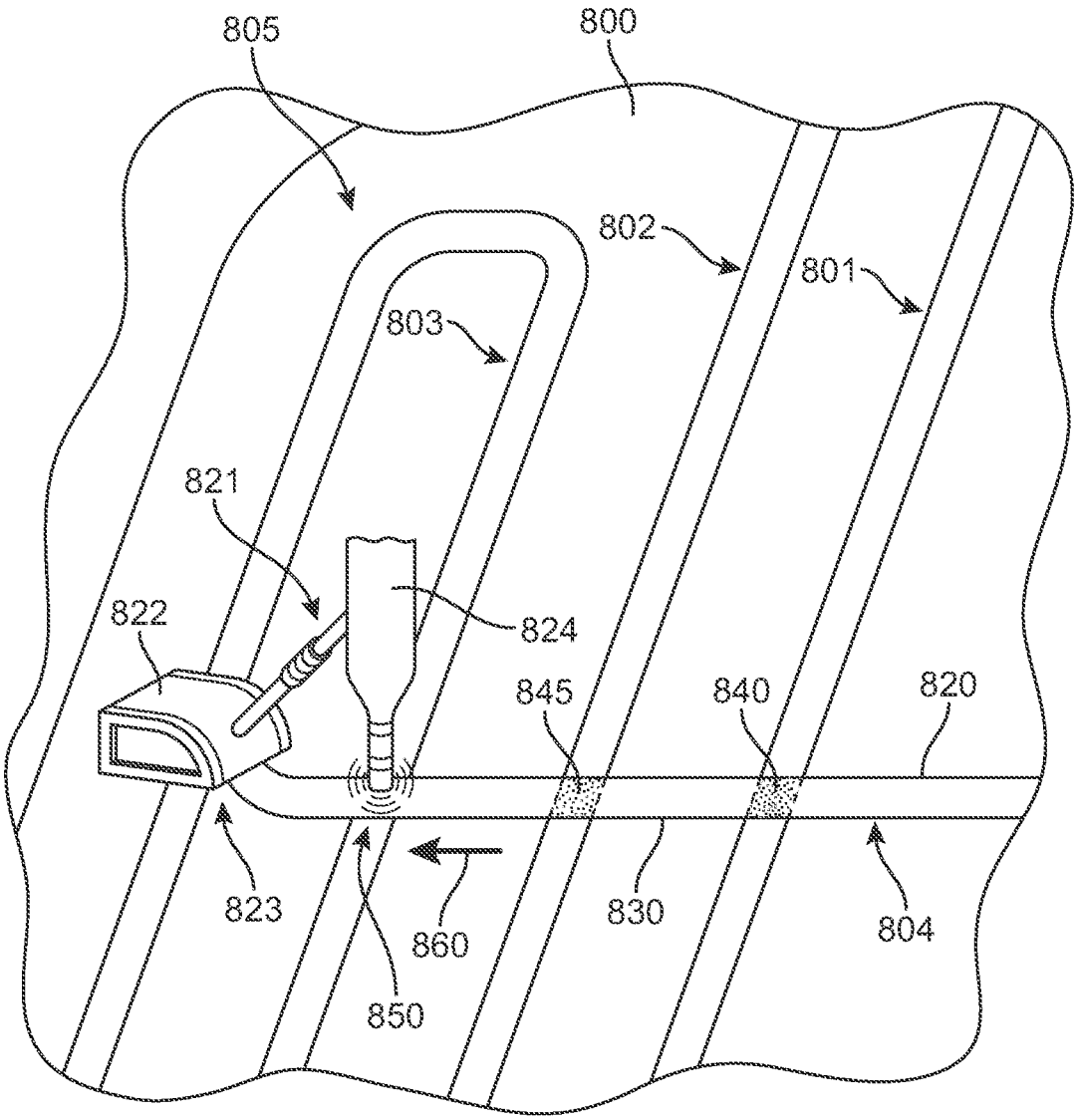
FIG. 8 is a schematic view of a process of manufacturing a ribbon structure including thermally bonding ribbon sections to one another.

FIG. 8 is a schematic view of another process of manufacturing a ribbon structure that includes thermally bonding ribbon sections to one another. FIG. 8 illustrates a surface 800 upon which a ribbon structure 805 is assembled. Surface 800 may be a substrate, backing layer, mesh layer, etc. A ribbon feeder 822 is schematically illustrated as dispensing a ribbon element 820 from a ribbon dispensing outlet 823 in an overlapping pattern of ribbon sections to form ribbon structure 805. In particular, a first layer of ribbon sections includes a first ribbon section 801, a second ribbon section 802, and a third ribbon section 803. As shown in FIG. 8, first ribbon section 801, second ribbon section 802, and third ribbon section 803 may be arranged substantially parallel to one another. In other embodiments, the arrangement of these ribbon sections in the first layer may be irregular. In addition, in FIG. 8, ribbon feeder 822 is shown laying down a fourth ribbon section 804, which overlaps first ribbon section 801, second ribbon section 802, and third ribbon section 803. Fourth ribbon section 804 overlaps first ribbon section 801 in a first overlapping region 840. Fourth ribbon section 804 overlaps second ribbon section 802 in a second overlapping region 845. And fourth ribbon section 804 overlaps third ribbon section 803 in a third overlapping region 850.

FIG. 8 also shows a method of fixedly attaching ribbon sections to an underlying material with thermal joining. In particular, as shown in FIG. 8, ribbon feeder 822 may be part of a multi-function apparatus 821, which also includes an ultrasonic horn 824. That is, in some embodiments, ultrasonic horn 824 may be attached to ribbon feeder 822 at a fixed distance from ribbon dispensing outlet 823 such that an energy applying tip of ultrasonic horn 824 performs the thermal joining of the ribbon proximate to ribbon dispensing outlet 823. Thus, as ribbon feeder 822 and ultrasonic horn 824 of multi-function apparatus 821 are moved along surface 800 in a direction 860, ultrasonic horn 824 may be used to selectively, fixedly attach ribbon sections to one another via thermally bonding. For example, ultrasonic horn 824 may be used to selectively apply ultrasonic energy to the overlapping regions of the ribbon sections, as illustrated by stippling in FIG. 8. As shown in FIG. 8, a span 830 of fourth ribbon section 804 remains unattached to surface 800. In other embodiments, the entire length or portions of the length of ribbon sections may be thermally bonded to surface 800.

Figure 9:
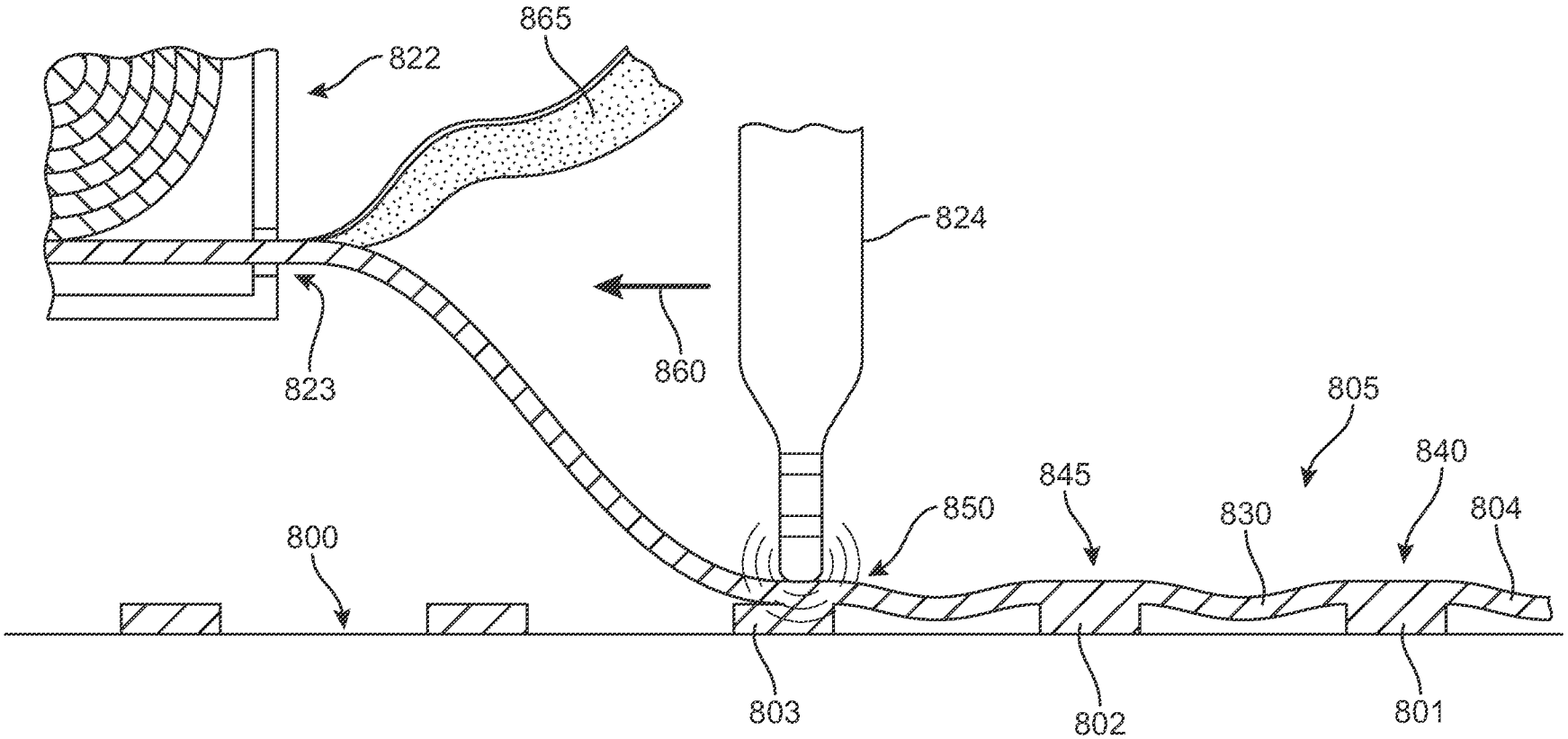
FIG. 9 is a schematic cross-sectional view of the process of thermally bonding ribbon sections to one another shown in FIG. 8.

FIG. 9 is a schematic cross-sectional view of the process of thermally bonding ribbon sections to one another shown in FIG. 8. As shown in FIG. 9, in some embodiments, the underlying material to which the ribbon sections are bonded, may be other segments of ribbon, e.g., in a different layer. As shown in FIG. 9, a thermal joint is provided between first ribbon section 801 and fourth ribbon section 804 in first overlapping region 840. In addition, a thermal joint is provided between second ribbon section 802 and fourth ribbon section 804 in second overlapping region 845. Also, an additional thermal joint is shown in FIG. 9 being produced in third overlapping region 850 between third ribbon section 803 and fourth ribbon section 804 by ultrasonic horn 824. It will be noted that, in span 830, fourth ribbon section 804 remains unattached to the underlying material.

As shown in FIG. 9, dispensing the ribbon may include removing the ribbon from a reel. Further, as also shown in FIG. 9, the method may include continuous removal of release paper 865 from the ribbon as it is removed from the reel.

Figure 10:
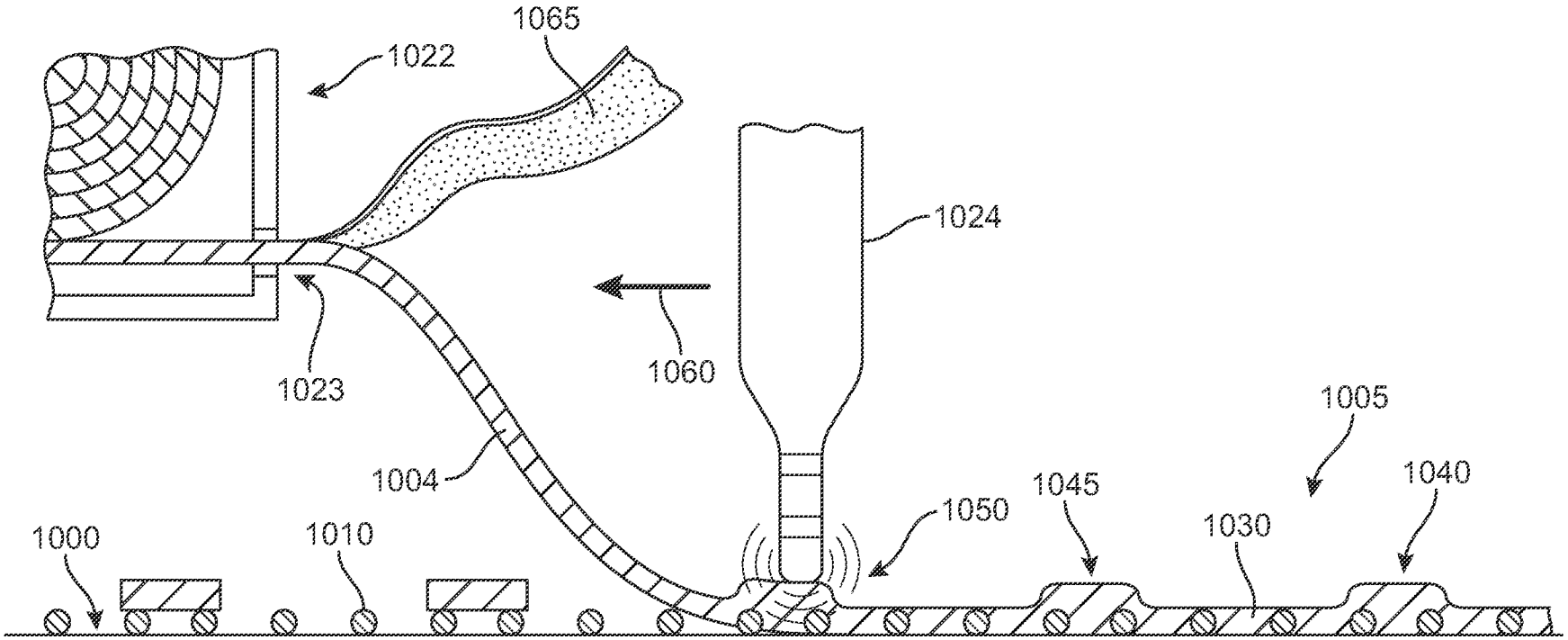
FIG. 10 is a schematic view of a process of thermally bonding ribbon sections to one another and to an underlying mesh.

In some embodiments, the ribbon sections may be not only thermally bonded to each other, but also thermally bonded to an underlying layer of material, such as a mesh. FIG. 10 is a schematic view of a process of thermally bonding ribbon sections to one another and to an underlying mesh. As shown in FIG. 10, a ribbon structure 1005 may be assembled by dispensing a ribbon element from a ribbon dispensing outlet 1023 of a ribbon feeder 1022. Release paper 1065 is continuously removed as the ribbon element is dispensed. As shown in FIG. 10, a mesh 1010 may be disposed on a surface 1000. Surface 1000 may be a backing layer that is later removed, or it may simply be a work surface upon which ribbon structure 1005 may be assembled. As the ribbon element is dispensed from ribbon feeder 1022, a ribbon section 1004 may be laid down on mesh 1010 and over other ribbon sections laid down by ribbon feeder 1022 earlier in the assembly process.

As shown in FIG. 10, ribbon section 1004 may be thermally bonded to not only the underlying ribbon sections, but also to mesh 1010. That is, as ribbon section 1004 is laid down, an ultrasonic horn 1024 follows behind ribbon feeder 1022 in a direction 1060 and thermally bonds the ribbon element continuously. In a first overlapping region 1040, a second overlapping region 1045, and a third overlapping region 1050, ribbon section 1004 is shown as thicker, where it has been thermally bonded to underlying ribbon sections. In addition, it will be noted that ribbon section 1004 and the underlying ribbon sections are also thermally bonded to mesh 1010. For example, in span 1030, mesh 1010 is shown as embedded in ribbon section 1004. The amount to which mesh 1010 is embedded within the ribbon sections may vary according to the design parameters of the upper.

In some embodiments, different layers of the upper may be formed of materials that melt at different temperatures. For example, a first layer of ribbon may be formed of a thermoplastic material that melts at a first temperature, and another layer of ribbon may be formed of a material that melts at a much higher temperature, such that the ultrasonic welding process only melts the first layer of ribbon. In effect, the first layer of ribbon is thermally bonded to the second layer of ribbon due to the melting of the first layer. Similarly, an underlying mesh may also be formed of a material with a much higher melting temperature. In some embodiments, an intermediate layer may have a higher melting temperature. For example, an intermediate ribbon layer may have a higher melting temperature in order to prevent an underlying mesh material from also melting.

Figure 11:
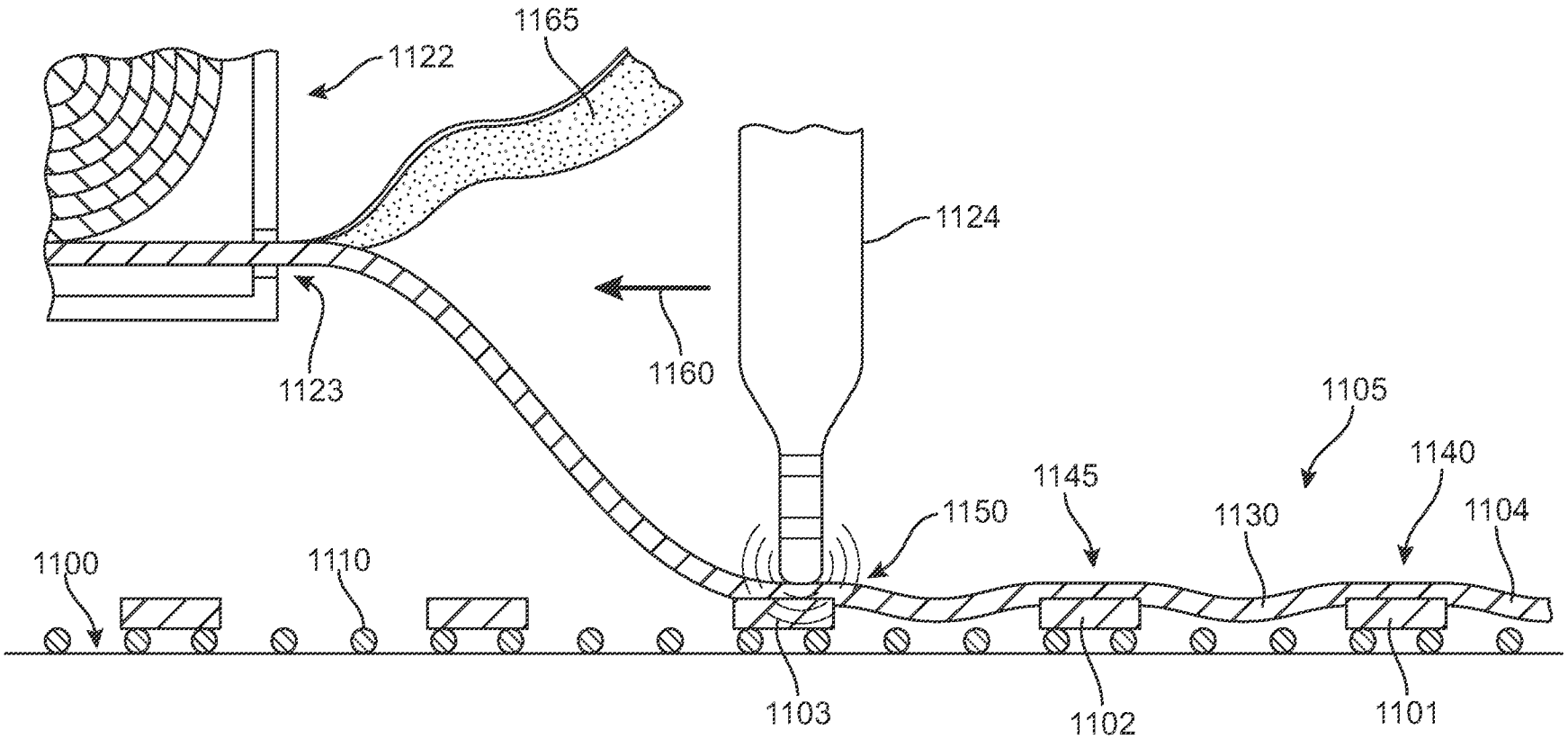
FIG. 11 is a schematic view of a process of thermally bonding a first layer of ribbon sections to a second layer of ribbon sections, but not to an underlying mesh.

FIG. 11 is a schematic view of a process of thermally bonding a first layer of ribbon sections to a second layer of ribbon sections, but not to an underlying mesh. As shown in FIG. 11, a ribbon structure 1105 may be assembled by dispensing a ribbon element from a ribbon dispensing outlet 1123 of a ribbon feeder 1122. Release paper 1165 is continuously removed as the ribbon element is dispensed. As shown in FIG. 11, a mesh 1110 may be disposed on a surface 1100. Surface 1100 may be a backing layer that is later removed, or it may simply be a work surface upon which ribbon structure 1105 may be assembled. As the ribbon element is dispensed from ribbon feeder 1122, a ribbon section 1104 may be laid down on mesh 1110 and over other ribbon sections laid down by ribbon feeder 1122 earlier in the assembly process.

As shown in FIG. 11, ribbon section 1104 may be thermally bonded to the underlying ribbon sections, but not to mesh 1110. That is, as ribbon section 1104 is laid down, an ultrasonic horn 1124 follows behind ribbon feeder 1122 in a direction 1160 and thermally bonds the ribbon element continuously. In a first overlapping region 1140, a second overlapping region 1145, and a third overlapping region 1150, ribbon section 1104 is shown as slightly molded around a first ribbon section 1101, a second ribbon section 1102, and a third ribbon section 1103, respectively. This slight deformation of ribbon section 1104 illustrates only ribbon section 1104 has been melted by ultrasonic horn 1124.

Whereas ribbon section 1104 may be formed of a meltable material, such as a thermoplastic material, first ribbon section 1101, second ribbon section 1102, and third ribbon section 1103 may be formed of a material having a melting point substantially higher than the thermoplastic material of the first layer of ribbon sections illustrated by ribbon section 1104. Accordingly, first ribbon section 1101, second ribbon section 1102, and third ribbon section 1103 have not been deformed by the ultrasonic welding. In addition, it will be noted that mesh 1110 is not embedded in either span 1130 of ribbon section 1104 or in the second layer of ribbon sections illustrated by first ribbon section 1101, second ribbon section 1102, and third ribbon section 1103.

In some embodiments, the plurality of ribbon sections may be translucent and have a first opacity. When two or more ribbon sections overlap one another, the opacities of the two or more ribbon sections combine to produce an overlapping region having a greater opacity. This may be used to provide the upper of the article of footwear with patterns of relatively lighter and darker appearance. That is, the color of the underlying material (e.g., a mesh) may show through the ribbon in lighter or darker shades depending on how many segments of ribbon are overlapping in a given location. The more layers overlapping, the darker the appearance. This can be used to identify areas in which the upper is reinforced.

Figure 12:
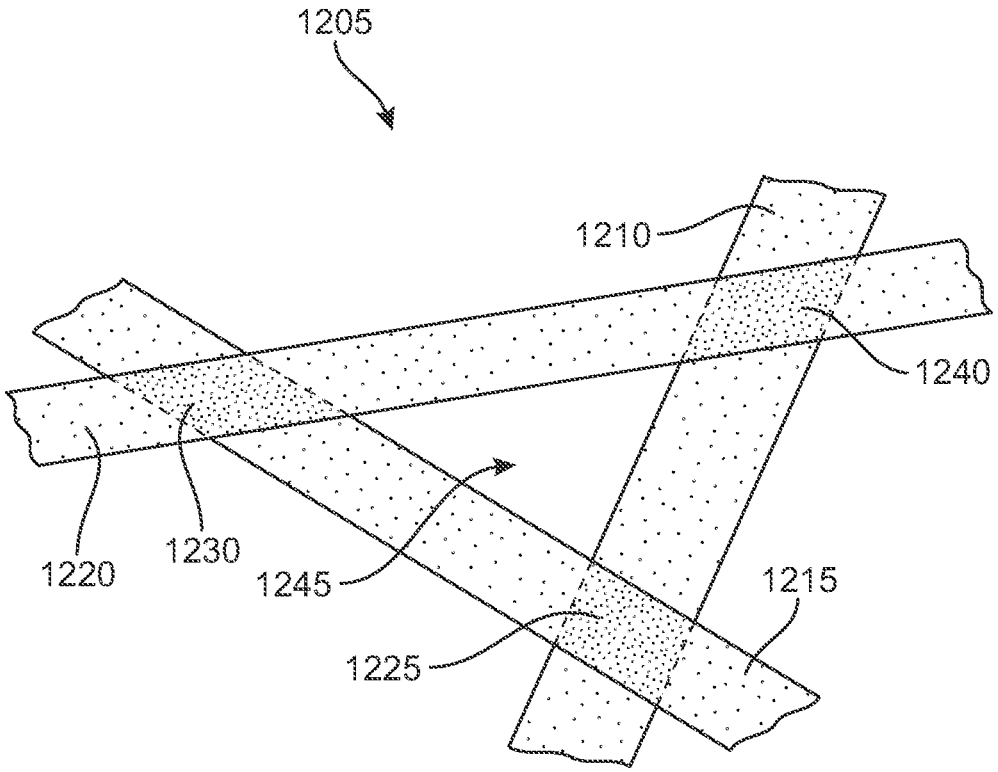
FIG. 12 is a schematic view of three overlapping ribbon sections, according to an exemplary arrangement, as identified in FIG. 1.

FIG. 12 is a schematic view of three overlapping ribbon sections, according to an exemplary arrangement, as identified in FIG. 1. FIG. 12 shows a ribbon structure 1205 including a first ribbon section 1210, and a second ribbon section 1215 overlapping first ribbon section 1210 in a first overlapping region 1225. Ribbon structure 1205 also includes a third ribbon section 1220, which overlaps second ribbon section 1215 in a second overlapping region 1230. In addition, third ribbon section 1220 overlaps first ribbon section 1210 in a third overlapping region 1240. As shown in FIG. 12, a central vacant area 1245 is provided, illustrating that, at no point do all three of the ribbon sections overlap.

First ribbon section 1210, second ribbon section 1215, and third ribbon section 1220 may be thermally bonded to one another in first overlapping region 1225, second overlapping region 1230, and third overlapping region 1240. In addition, each of first ribbon section 1210, second ribbon section 1215, and third ribbon section 1220 is translucent and is shown to have a common level of opacity by stippling. In first overlapping region 1225, second overlapping region 1230, and third overlapping region 1240, the opacities of the ribbon sections are combined to produce a greater opacity, as illustrated by darker stippling in FIG. 12.

Thus, the overlapping regions include two-layer overlapping regions in which a first ribbon section having a first opacity overlaps a second ribbon section having the same opacity, wherein the two-layer overlapping regions have a second opacity that is greater than the first opacity. In some embodiments, the ribbon structure may include three-layer (or more) overlapping regions. The three layer overlapping regions may have a third opacity that is greater than the second opacity of the two-layer overlapping regions. In some embodiments, a single upper for an article of footwear may include both two-layer and three-layer overlapping regions, as shown in FIG. 1.

Figure 13:
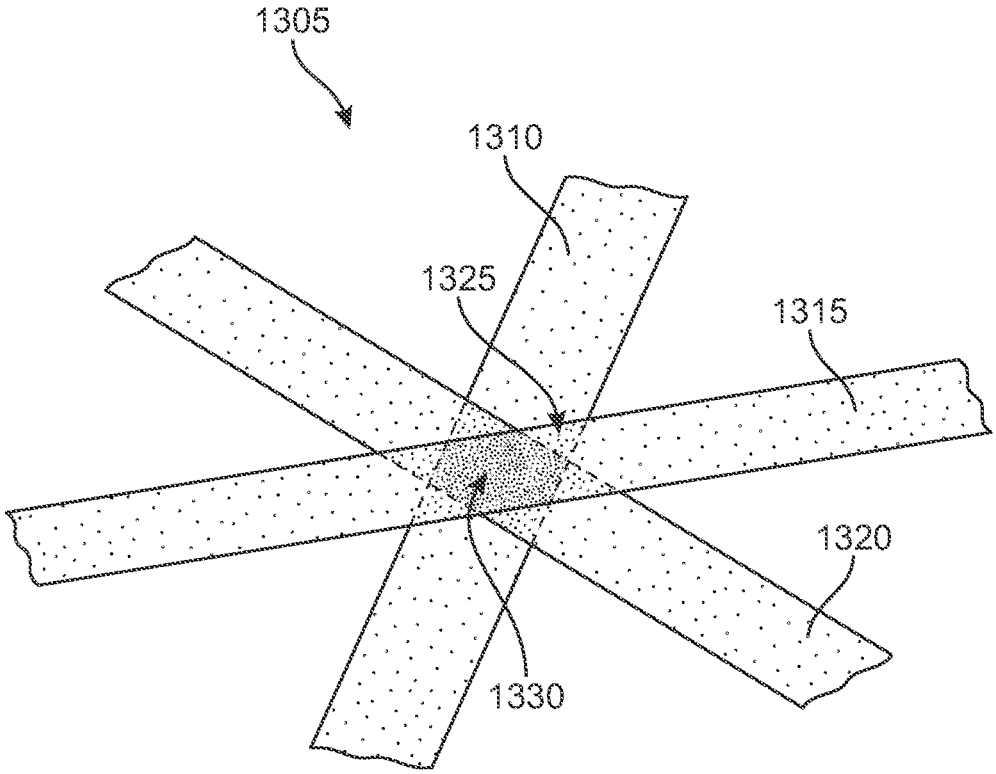
FIG. 13 is a schematic view of three overlapping ribbon sections, according to another exemplary arrangement, as identified in FIG. 1.

FIG. 13 is a schematic view of three overlapping ribbon sections, according to another exemplary arrangement, as identified in FIG. 1. As shown in FIG. 13, a ribbon structure 1305 may include a first ribbon section 1310, a second ribbon section 1315, and a third ribbon section 1320, which may overlap in a three-layer overlapping region 1330. In addition, the three ribbon sections may also overlap one another in one or more two-layer overlapping regions 1325. First ribbon section 1310, second ribbon section 1315, and third ribbon section 1320 may be thermally bonded to one another in three-layer overlapping region 1330 and/or two-layer overlapping regions 1325.

In addition, each of first ribbon section 1310, second ribbon section 1315, and third ribbon section 1320 is translucent and is shown to have a first opacity by stippling. In two-layer overlapping regions 1325, a darker stippling is shown to illustrate a second opacity that is greater than in the first opacity of the ribbon sections individually. In addition, in three-layer overlapping region 1330, an even darker stippling is used to illustrate a third opacity that is greater than the second opacity.

In some embodiments, different layers of the upper may have different levels of elasticity. In some embodiments, the ribbon sections may be elastic. In some cases, the ribbon sections may have differing levels of elasticity in different orientations and/or in different areas of the upper. In addition, in some embodiments, the ribbon sections may be substantially inelastic, and may be used to selectively restrict stretching of an underlying mesh, which may be elastic.

Figure 14:
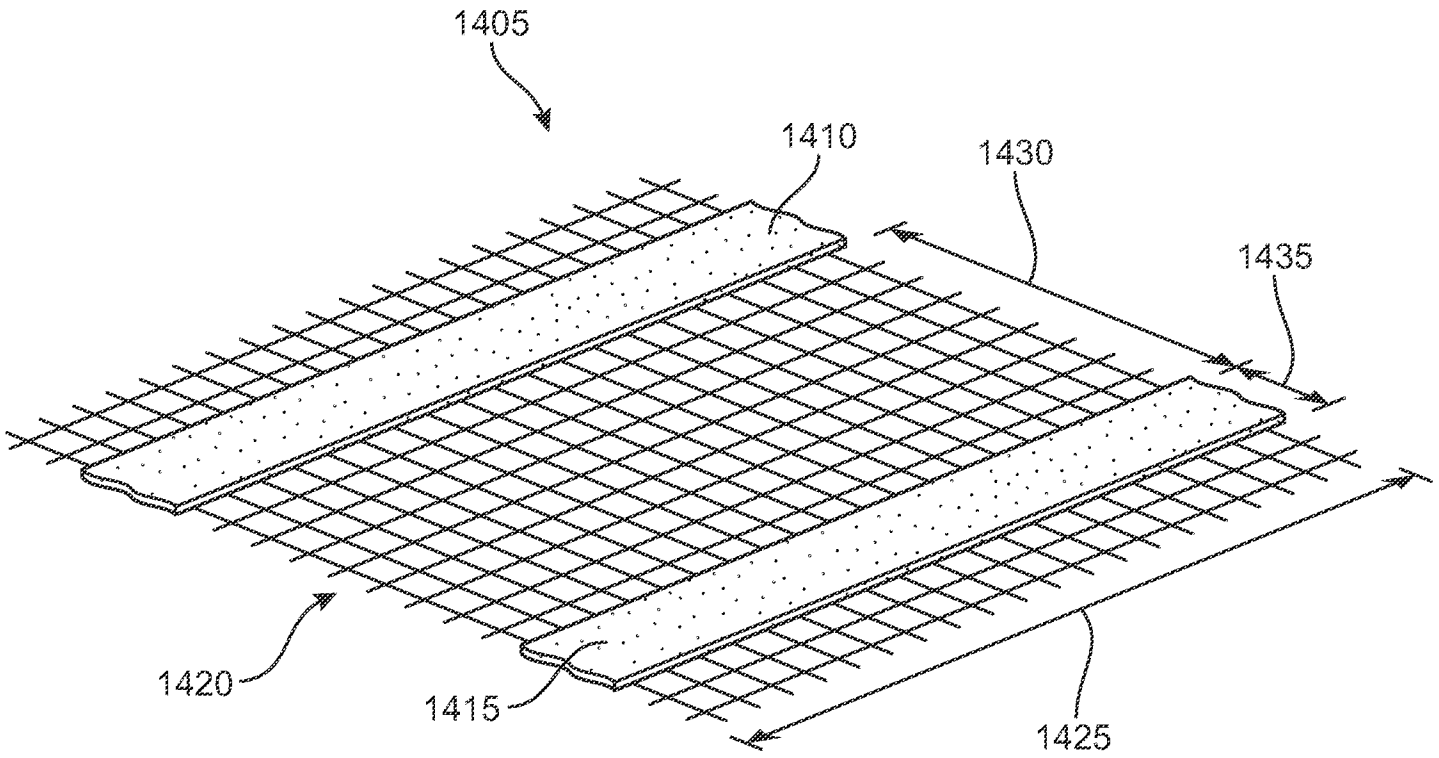
FIG. 14 is a schematic isometric view of a portion of a multilayer material including a ribbon structure affixed to an underlying elastic mesh layer.

FIG. 14 is a schematic isometric view of a portion of a multi-layer material including a ribbon structure affixed to an underlying elastic mesh layer. FIG. 14 illustrates a multi-layer material 1405, which may be used to form a portion of an upper of an article of footwear. Multi-layer material 1405 may include a first ribbon section 1410 and a second ribbon section 1420. First ribbon section 1410 and second ribbon section 1415 may be fixedly attached to an underlying elastic sheet of material. In FIG. 14, the underlying elastic sheet of material is an elastic mesh 1420.

While elastic mesh 1420 may have multi-directional elasticity, the ribbon sections may restrict the stretching of elastic mesh 1420 in one or more directions. As shown in FIG. 14, the portion of multi-layer material 1405 is shown as having a length 1425. It will be noted that both elastic mesh material 1420 and second ribbon section 1415 have substantially the same length in FIG. 14. In addition, the span of elastic mesh 1420 between first ribbon section 1410 and second ribbon section 1415 may have a first width 1430. Also, second ribbon section 1415 is shown as having a second width 1435.

Figure 15:
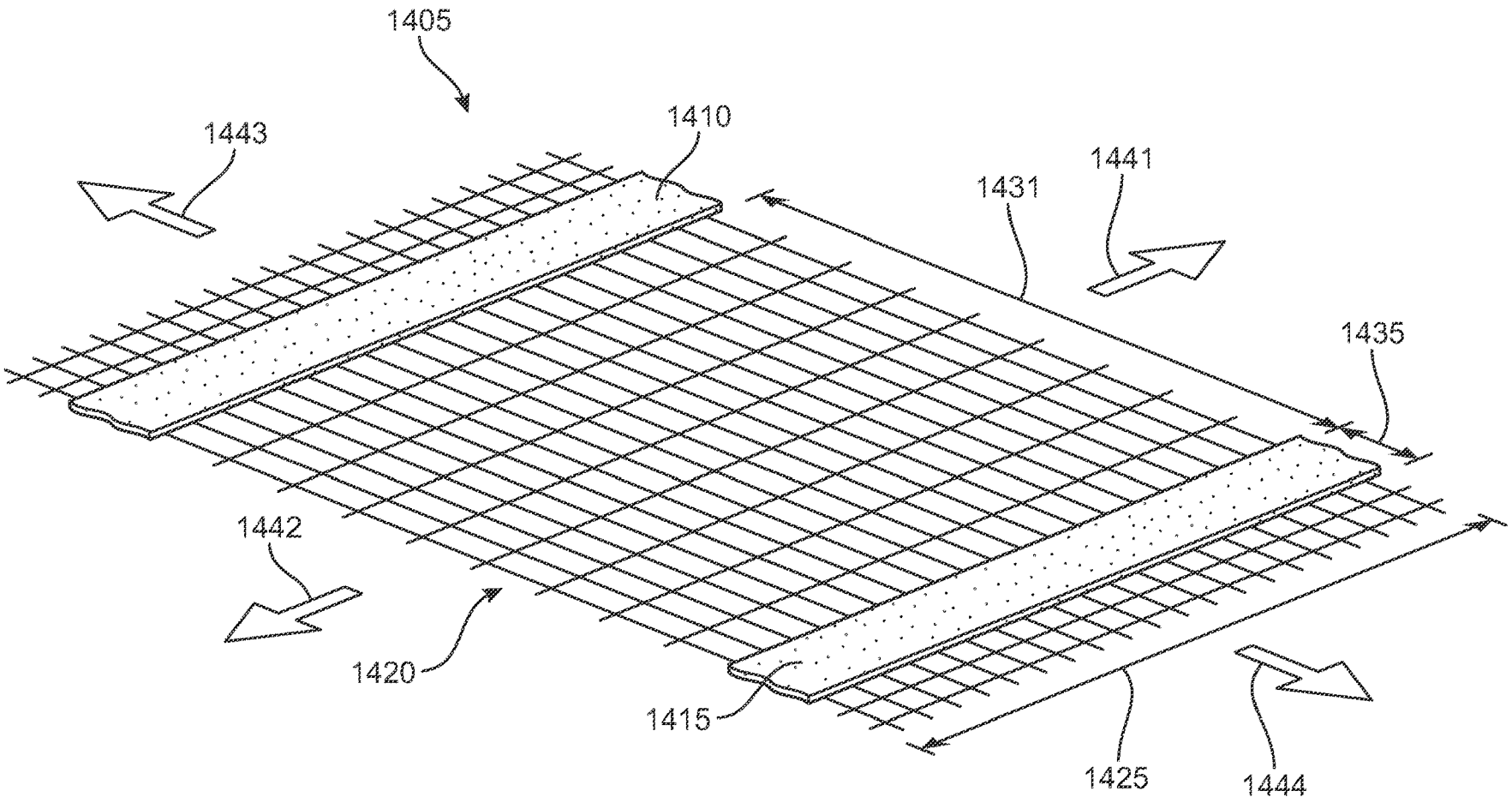
FIG. 15 is a schematic isometric view of the multilayer material of FIG. 14 shown in a stretched condition.

FIG. 15 is a schematic isometric view of multi-layer material 1405 of FIG. 14 shown in a stretched condition, and illustrates the selective restriction as to which direction multi-layer material 1405 is permitted to stretch. In FIG. 15, multi-layer material 1405 is subjected to equivalent tension in two dimensions. In particular, multi-layer material 1405 is placed in tension along its length, as illustrated by a first arrow 1441 and an opposing second arrow 1442. In addition, multi-layer material 1405 is placed in tension along its width, as illustrated by a third arrow 1443 and an opposing fourth arrow 1444. However, it can be seen that multi-layer material 1405 only stretches along its width and not along its length. This is because first ribbon section 1410 and second ribbon section 1415 are formed of substantially inelastic materials. For purposes of this disclosure, the term "substantially inelastic" shall refer to a material that does not elongate significantly when placed under loading of the magnitude typically experienced in the upper of an article of footwear.

As shown in FIG. 15, the length 1425 of multi-layer material 1405, including elastic mesh 1420, as well as first ribbon section 1410 and second ribbon section 1415, remains the same as it was before placed in tension. This is because the inelasticity of first ribbon section 1410 and second ribbon section 1415 substantially prevents any elongation of multi-layer material 1405. Similarly, the width 1435 of second ribbon section 1415 also remains the same as it was pre-tension. However, the span of elastic mesh 1420 between first ribbon section 1410 and second ribbon section 1415 is shown to have elongated to a third width 1431, which is greater than first width 1430 shown in FIG. 14. Thus, multi-layer material 1405 is elastic in one direction (i.e., its length) and substantially inelastic in a second direction (i.e., its width).

The orientations and arrangement of ribbon sections and other inelastic elements may be configured to provide the upper of an article of footwear with desired performance characteristics in different areas of the shoe. For example, in some areas of the upper, it may be desirable to provide the article of footwear with elasticity in the lateral direction, but have it remain substantially inelastic in the longitudinal direction. In other areas of the upper, it may be desirable for it to be substantially inelastic in the lateral direction and elastic in the longitudinal direction. These envisioned configurations are merely exemplary, and any variance in the orientations and configurations of the ribbon sections may be implemented to provide the upper with desired characteristics in terms of elasticity.

It will also be appreciated that the components or layers of the upper that are elastic may be disposed on the outer side of the upper, the inner side of the upper, or intermediate the outer and inner sides. For example, in some cases, the elastic mesh layer may be disposed inward of at least one layer of ribbon sections. By providing at least one layer of ribbon sections external to the elastic mesh, the ribbon sections may provide both protection from damage to the mesh, as well as a supportive function by virtue of being disposed around the outside of the shoe. Thus, the ribbon sections may essentially hold the shoe together against forces exerted by the wearer's foot, which generally push outward on the upper from the inside.

While various embodiments have been described, the description is intended to be exemplary, rather than limiting, and it will be apparent to those of ordinary skill in the art that many more embodiments and implementations are possible that are within the scope of the embodiments. Although many possible combinations of features are shown in the accompanying figures and discussed in this detailed description, many other combinations of the disclosed features are possible. Any feature of any embodiment may be used in combination with or substituted for any other feature or element in any other embodiment unless specifically restricted. Therefore, it will be understood that any of the features shown and/or discussed in the present disclosure may be implemented together in any suitable combination. Accordingly, the embodiments are not to be restricted except in light of the attached claims and their equivalents. Also, various modifications and changes may be made within the scope of the attached claims.

What is claimed is:

1. A method of manufacturing an upper for an article of footwear, the method comprising:

dispensing ribbon from a multi-function apparatus that includes a ribbon feeder and an ultrasonic horn, wherein the ribbon is dispensed from a ribbon dispensing outlet of the ribbon feeder in an overlapping pattern of ribbon sections to form a ribbon structure and wherein the ultrasonic horn is attached to the ribbon feeder at a fixed distance from the ribbon dispensing outlet; and thermally joining a first ribbon section to an underlying material using the ultrasonic horn of the multi-function apparatus.

2. The method of claim 1, wherein the ribbon is dispensed from the ribbon feeder in a first direction; and wherein the thermal joining is performed by the ultrasonic horn that follows behind the ribbon feeder in the first direction.

3. The method of claim 1, wherein an energy applying tip of the ultrasonic horn performs the thermal joining of the first ribbon section proximate to the ribbon dispensing outlet.

4. The method of claim 1, wherein the underlying material is a second segment of the ribbon.

5. The method of claim 1, wherein the thermal joining includes selectively applying ultrasonic energy to the first ribbon section at overlapping regions where the first ribbon section overlaps additional ribbon sections in the pattern.

6. The method of claim 1, wherein the underlying material is a mesh.

7. The method of claim 1, wherein dispensing the ribbon includes removing the ribbon from a reel of the ribbon feeder; and wherein the method further includes continuous removal of release paper from the ribbon as the ribbon is removed from the reel while the ribbon is being dispensed.

8. The method of claim 1, further including stitching the ribbon to the underlying material after dispensing the ribbon and prior to the thermal joining of the ribbon to the underlying material.

9. The method of claim 1, further comprising selectively joining portions of the first ribbon section to the underlying material such that at least one span of the first ribbon section remains unattached to the underlying material.

10. A method of manufacturing an upper for an article of footwear, the method comprising:

forming a ribbon structure including a plurality of ribbon sections arranged in an overlapping pattern, the plurality of ribbon sections including a first set of ribbon sections and a second set of ribbon sections;

wherein forming the ribbon structure includes dispensing the plurality of ribbon sections from a multi-function apparatus that includes a ribbon feeder and an ultrasonic horn, wherein the plurality of ribbon sections are dispensed from a ribbon dispensing outlet of the ribbon feeder and wherein the ultrasonic horn is attached to the ribbon feeder at a fixed distance from the ribbon dispensing outlet; and selectively, thermally joining the first set of ribbon sections to the second set of ribbon sections using the ultrasonic horn of the multi-function apparatus.

11. The method of claim 10, further comprising selectively joining portions of the first set of ribbon sections to the second set of ribbon sections such that at least one span of ribbon from the first set ribbon sections remains unattached to the second set of ribbon sections.

12. The method of claim 10, wherein the plurality of ribbon sections are dispensed from the ribbon feeder in a first direction; and wherein the thermal joining is performed by the ultrasonic horn that follows behind the ribbon feeder in the first direction.

13. The method of claim 10, further including fixedly attaching one or more of the plurality of ribbon sections to an underlying mesh layer.

14. The method of claim 13, further including stitching the ribbon to underlying material after dispensing the ribbon and prior to the thermal joining of the ribbon to the underlying material.

15. The method of claim 10, wherein an energy applying tip of the ultrasonic horn performs the thermal joining of the plurality of ribbon sections proximate to the ribbon dispensing outlet.

16. A method of manufacturing an upper for an article of footwear, the method comprising:

forming a ribbon structure including a plurality of ribbon sections including a first set of ribbon sections and a second set of ribbon sections arranged in an overlapping pattern to form a plurality of overlapping regions;

wherein forming the ribbon structure includes dispensing the plurality of ribbon sections from a multi-function apparatus that includes a ribbon feeder and an ultrasonic horn, wherein the plurality of ribbon sections are dispensed from a ribbon dispensing outlet of the ribbon feeder and wherein the ultrasonic horn is attached to the ribbon feeder at a fixed distance from the ribbon dispensing outlet; and selectively, thermally joining the first set of ribbon sections to the second set of ribbon sections with thermal joining using the ultrasonic horn of the multi-function apparatus;

wherein the plurality of ribbon sections are translucent and have a first opacity;

wherein the overlapping regions have a second opacity that is greater than the first opacity.

17. The method of claim 16, further comprising selectively joining portions of the first set of ribbon sections to the second set of ribbon sections such that at least one span of ribbon from the first set ribbon sections remains unattached to the second set of ribbon sections.

18. The method of claim 16, wherein the plurality of ribbon sections are dispensed from the ribbon feeder in a first direction; and wherein the thermal joining is performed by the ultrasonic horn that follows behind the ribbon feeder in the first direction.

19. The method of claim 16, further including fixedly attaching one or more of the plurality of ribbon sections to an underlying mesh layer.

20. The method of claim 19, wherein the method further includes stitching the ribbon to underlying material after dispensing the ribbon and prior to the thermal joining of the first set of ribbon sections to the second set of ribbon sections.

* * * * *